United States Patent [19]

Kikuno et al.

[11] Patent Number: 4,799,081

[45] Date of Patent: Jan. 17, 1989

[54] COPYING SYSTEM HAVING COPYING AND SERVICE PROGRAM MODES

[75] Inventors: Mitsutoyo Kikuno, Machida; Tatsuo Hirono, Kawasaki; Yoshihiro Nakashima, Tateishi; Hirobumi Yoshino, Tokyo, all of Japan

[73] Assignee: Ricoh Company, Ltd., Tokyo, Japan

[21] Appl. No.: 42,448

[22] Filed: Apr. 24, 1987

[30] Foreign Application Priority Data

Apr. 28, 1986 [JP] Japan ..... 61-100257

[51] Int. Cl.[4] ..... G03G 15/00

[52] U.S. Cl. ..... 355/14 C

[58] Field of Search ..... 355/14 R, 14 C, 8

[56] References Cited

U.S. PATENT DOCUMENTS

| | | | |
|---|---|---|---|
| 4,297,029 | 10/1981 | Carlson | 355/14 R X |
| 4,332,464 | 6/1982 | Bartulis et al. | 355/14 C |
| 4,547,062 | 10/1985 | Fujiwara | 355/14 C X |
| 4,553,830 | 11/1985 | Nguyen | 355/14 R |
| 4,627,721 | 12/1986 | Nguyen et al. | 355/14 R X |
| 4,682,158 | 7/1987 | Ito et al. | 355/14 C X |

OTHER PUBLICATIONS

*IBM Technical Disclosure Bulletin*, vol. 23, No. 7A, Dec. 1980, Laliberty et al, "Diagnostic Mode Exercising for Copiers", pp. 2714–2715.

*Primary Examiner*—Arthur T. Grimley
*Assistant Examiner*—J. Pendegrass
*Attorney, Agent, or Firm*—Oblon, Fisher, Spivak, McClelland & Maier

[57] ABSTRACT

A copying system comprises a first circuit for selecting a copying mode or a service program mode responsive to a manipulation of one or a plurality of keys, a second circuit for setting an operation mode to the service program mode when enabled by the first circuit, and a control device for automatically resetting one of a plurality of predetermined service program modes when the second circuit is disabled by the first circuit. Adjusting data for use in adjusting parts of the copying system in the service program mode are entered from the keys, and the predetermined service program modes are automatically reset when the operation mode is changed from the service program mode to the copying mode.

14 Claims, 24 Drawing Sheets

START
150
N = SPo
N OUT
151
SPID IN
152
77 ON ?
NO
YES
153
SPID = K12 ?
NO
RTN
YES
154
N = K13 + SPo
N OUT
D
155
70 & 77 ON ?
YES
156
RST DIP SW
RTN
NO
157
SPMN IN
158
77 ON ?
NO
YES
159
N = SPo + SPMN
160
SPMN ≦ K14 ?
NO
YES
161
CDIPS = 0
162
N, DSPMN CDIPS OUT
163
LED ON
E
F

FROM FIG. 6
200
LED ON
201
GF = 1
202
DCM = N
203
DETERMINE NIG
204
N = NIG
N OUT
205
N = N + 1
206
207
N = NIG + K20 ?
NO
YES
212
T ON
208
N = DCM
213
71 ON ?
NO
YES
209
N OUT
214
T COUNT UP ?
NO
YES
210
GF = 0
211
LED OFF
B

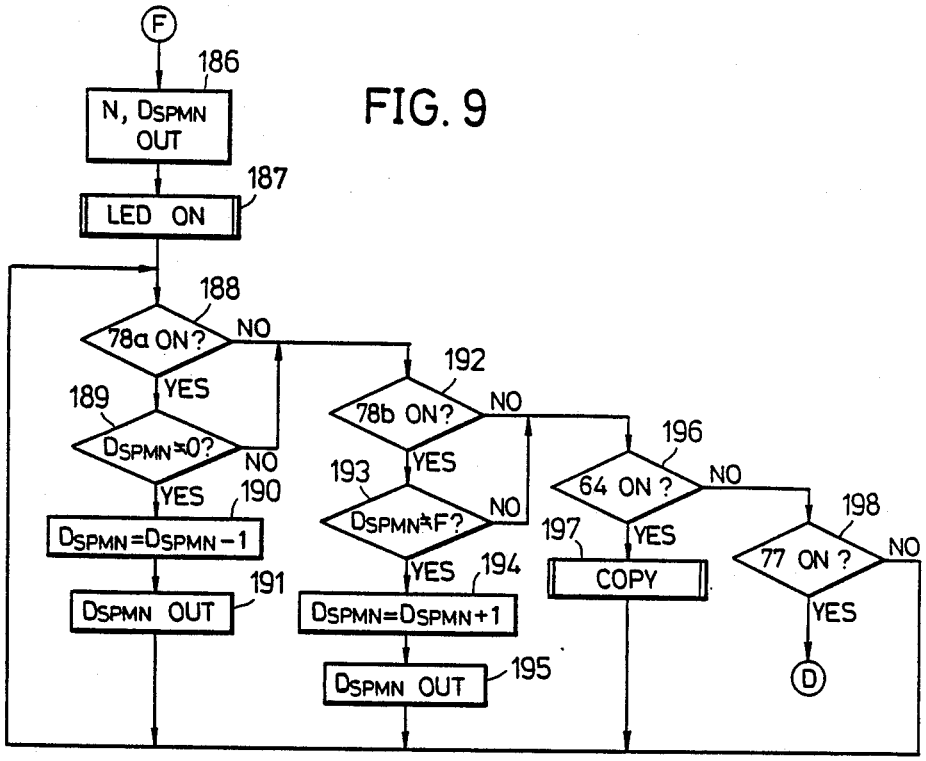
FIG. 9
FIG. 12
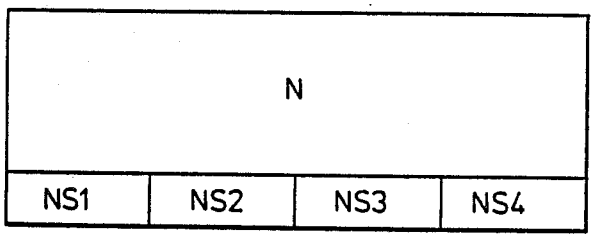

FIG. 25

| | |
|---|---|
| 00000H ∫ 07FFFH | ROM0 |
| 08000H ∫ 0FFFFH | ROM1 |
| 10000H ∫ 17FFFH | ROM2 |
| 18000H ∫ 1FFFFH | ROM3 |
| 20000H ∫ 27FFFH | ROM4 |
| 28000H ∫ 2FFFFH | ROM5 |
| 30000H ∫ 37FFFH | ROM6 |
| 38000H ∫ 3FFFFH | ROM7 |
| 40000H ∫ 47FFFH | ROM8 |
| 48000H ∫ 4FFFFH | ROM9 |
| 60000H ∫ 60003H | HD61830 |
| 61000H | Ⓒ |
| 62000H | Ⓓ |
| 63000H ∫ 63003H | 8253 |
| 64000H 64001H | 8259A |
| 68000H ∫ 69FFFH | RAM0 |
| 6A000H ∫ 6A003H | 8255 |

| 7 | 6 | 5 | 4 | 3 | 2 | 1 | 0 |
|---|---|---|---|---|---|---|---|
| 0 | 0 | 0 | 0 | * | * | * | * |

| | 7 | 6 | 5 | 4 | 3 | 2 | 1 | 0 | |
|---|---|---|---|---|---|---|---|---|---|
| FIG. 39A | 1 | 1 | 1 | 0 | * | * | * | * | N |
| FIG. 39B | 1 | 1 | 0 | 0 | * | * | * | * | NS1 |
| FIG. 39C | 1 | 0 | 1 | 0 | * | * | * | * | NS2 |
| FIG. 39D | 1 | 0 | 0 | 0 | * | * | * | * | NS3 |
| FIG. 39E | 0 | 1 | 1 | 0 | * | * | * | * | NS4 |
| FIG. 40A | 0 | 1 | 1 | 1 | * | * | * | * | N5 |
| FIG. 40B | 0 | 1 | 0 | 0 | * | * | * | * | N6 |
| FIG. 41 | 0 | 0 | 1 | 1 | * | * | * | * | NP |

256
①
②
64

512
②
①
32

IC107

VRAM
69000H
697FFH

COPYING SYSTEM HAVING COPYING AND SERVICE PROGRAM MODES

BACKGROUND OF THE INVENTION

The present invention generally relates to copying systems, and more particularly to a copying system comprising a display for helping the user operate the copying system so as to carry out a desired function of a copying mode and for helping the serviceman operate the copying system so as to carry out a desired function check of a service program mode.

A copying system generally has a copying mode and a service program mode. The copying system is in the copying mode when the user wishes to make a copy of an original. The copying system has various functions in the copying mode, including designations of the copy size, copy quantity, size magnification, image density, one-sided copy or two-sided copy, sorting of copies, image shift, automatic reduce/enlarge, automatic paper select, automatic document feed, and the like. On the other hand, the copying system is in the service program mode when final adjustments are made on the copying system at the factory and when the serviceman wishes to adjust and/or repair the copying system of the user.

As is well known, the copying system also has a self-check mode in which the operation state of the copying system is automatically checked when a power source switch (or main switch) is turned ON.

In the service program mode, there are various modes for checking whether or not parts of the copying system operate correctly or are as initially set, and these modes are used to check the exposure, bias potential, sensitivity of jam sensor, the state of clutch, solenoid and the like. The modes of the service program mode can be divided into a free-run mode in which all of the parts of the copying system operate similarly as in the case of the copying mode except that no paper is fed so as to check the sequential operation of the parts, and an independent driving mode in which each part of the copying system is driven independently to check the individual parts.

Conventionally, the copying system is set to the service program mode by connecting a dual-inline package switch (hereinafter simply referred to as DIP switch) or the like on a circuit board of the copying system. Each mode of the service program mode is set by the serviceman who manipulates the DIP switch. However, when the serviceman forgets to reset the data entered from the DIP switch after the adjustment and/or the repair of the copying system is completed, there is a problem in that the copying system will not operate correctly in the copying mode. In extreme cases, parts of the copying system may be damaged if the copying system is operated in the copying mode with the data entered from the DIP switch still set in the copying system.

In the service program mode, the data for carrying out the various adjustments such as adjusting the resist and the exposure voltage are entered by manipulating a variable resistor, a digit switch or the like on a control circuit board. However, in order to carry out the adjustments by manipulating the variable resistor, the digit switch or the like, it is necessary to open a door (or cover) of the copying system and then close the door after the adjustments are completed. Thus, the conventional copying system suffers a problem in that the operation of entering the data for carrying out the adjustments in the service program mode is troublesome to perform.

On the other hand, in the copying mode, there are conventional copying systems which display the contents of various modes and abnormalities. However, most of the conventional copying systems simply display a picture word to show the state of mechanisms in the system. There are some copying systems which display characters instead of the picture word, but these copying systems do not have displays for describing the function of keys, describing each mode of the copying mode, giving guidance on how to supply the supplies and the like. There are copying systems which give limited guidance to the user, but the display of one guidance must be finished before the next guidance can be displayed. For this reason, when it takes a relatively long time to finish a first guidance, there is a problem in that the user must wait for a predetermined time until the next guidance is displayed even when the user can readily understand the first guidance.

In addition, each mode setting key of the conventional copying system can only set one mode of the copying mode. For this reason, the number of mode setting keys increase as the number of modes of the copying mode increasess. When a large number of mode setting keys are provided, it is not only confusing to the user which mode setting key sets a certain mode, it also makes the copying system expensive.

Various abnormalities in the copying system is displayed, and conventionally, the abnormalities such as mechanical failure, paper jam, open door are displayed by independent indicator elements. It is possible to conceive a copying system which uses a single display (dot matrix display) for displaying various information by switching the display. But while a mode setting information is displayed on the single display, for example, it is impossible to display an abnormality on the same display even when an abnormality is detected in the self-check mode.

When setting a mode in the copying mode, the data entered from the various keys are displayed on a display. However, in the conventional copying system, no indication is given as to which keys are valid in a selected mode. The user may find out that a key is invalid in a mode when the display does not change when he manipulates the key, but this is extremely troublesome for the user and the user may unnecessarily make incorrect manipulation of the keys. On the other hand, there is a copying system which generates a buzzer sound when a manipulated key is valid in a selected mode. However, there is a problem in that the key must be manipulated before the user can actually find out whether or not the manipulated key is valid in the selected mode.

Furthermore, in the conventional copying system in which a plurality of modes can be set simultaneously in the copying mode, a key is provided for each mode and an indicator is provided in correspondence with each key so that the indicator is turned ON when the corresponding key is manipulated, in order that the user may easily see which keys have been manipulated. However, the number of keys and the number of indicators increase as the number of modes increases. Hence, there is a problem in that the operation part of the copying system is difficult to operate and understand because of the large number of keys and indicators, and the copying system becomes expensive due to the large number of keys and indicators.

SUMMARY OF THE INVENTION

Accordingly, it is a general object of the present invention to provide a novel and useful copying system in which the problems described heretofore are eliminated.

Another and more specific object of the present invention is to provide a copying system comprising enabling and disabling means, service program mode setting means for selecting a service program mode when enabled by the enabling and disabling means, and control means for automatically resetting one or a plurality of predetermined service program modes when the service program mode setting means is disabled by the enabling and disabling means. According to the copying system of the present invention, the enabling and disabling means enables the service program setting means when the operation mode of the copying system is set to the service program mode and disables the service program setting means when the operation mode is switched to the copying mode from the service program mode. Hence, there is no need to reset the adjusting data entered in the service program mode when the adjustments and/or repair is completed, and it is possible to positively prevent the parts of the copying system from being damaged in the copying mode as was the case in the conventional copying system, because the predetermined service program modes are automatically reset when the operation mode is switched to the copying mode.

Still another object of the present invention is to provide a copying system in which the control means validates an input from a copy start key in addition to inputs from keys of the service program setting means. According to the copying system of the present invention, it is possible to correct the adjusting data while observing the image on the copy.

A further object of the present invention is to provide a copying system which comprises mode setting keys for setting modes of the copying mode and the service program mode, a guidance key for selecting a guidance and a display for displaying the guidance, and the control means controls the guidance displayed on the display so that a guidance related to a mode setting key is changed to a guidance related to another mode setting key immediately after the other mode setting key is manipulated. According to the copying system of the present invention, it is possible to know the function and operation of the keys within a short period of time.

Another object of the present invention is to provide a copying system which comprises mode setting keys for setting modes of the copying mode and the service program mode, a guidance key for selecting a guidance and a display for displaying a guidance, and the control means stores data displayed on the display during the setting of a mode into a memory when the guidance key is manipulated, changes the display mode to a guidance display mode and displays the data stored in the memory on the display when the guidance key is manipulated the second time so that the data displayed on the display is returned to the original data which was displayed when the guidance key was manipulated the first time. According to the copying system of the present invention, it is possible to return the data displayed on the display to the original data which was displayed when the guidance key was manipulated the first time before the guidance is finished.

Still another object of the present invention is to provide a copying system which comprises mode setting keys for setting modes of the copying mode and the service program mode, a guidance key for selecting a guidance and a display for displaying a guidance, and the control means changes the display mode from a mode display mode to a guidance display mode when the guidance key is manipulated during the setting of a mode so that the display of the modes is changed to the display of the guidance related to the selected mode. According to the copying system of the present invention, the operation of the copying system can easily be understood by the user even when the user operates the copying system for the first time.

A further object of the present invention is to provide a copying system which comprises mode setting keys for setting modes of the copying mode and the service program mode, a guidance key for selecting a guidance and a display for displaying a guidance, and the control means switches and controls the display so that the mode can be changed to a mode set by a mode setting key when a guidance of the mode setting key is finished. According to the copying system of the present invention, the operation of the copying system can easily be understood by the user even when the user operates the copying system for the first time.

Another object of the present invention is to provide a copying system which comprises mode setting keys for setting modes of the copying mode and the service program mode and a display for displaying various data, and the control means displays a mode set by a mode setting key in a display part of the display corresponding in position to the mode setting key. According to the copying system of the present invention, it is possible to set a plurality of modes by use of a small number of mode setting keys.

Still another object of the present invention is to provide a copying system which comprises mode setting keys for setting modes of the copying mode and the service program mode and a display for displaying a guidance, and the control means stores data displayed on the display into a memory when a copy start key is manipulated and displays the data stored in the memory when the copying operation is completed so as to return the data displayed on the display to the original data which was displayed when the copy start key was manipulated. According to the copying system of the present invention, it is possible to confirm in which mode the copying operation was carried out when the copying operation is completed. In addition, it is unnecessary to set the mode from the beginning when carrying out the copying operation again by readjusting the set data while observing the image of the copy.

A further object of the present invention is to provide a copying system which comprises a display for displaying data on a set mode, data on a mechanical state, adjusting data for a service program mode and data for guidance, and the control means displays on the display specific data on the mechanical state with a priority over other data. According to the copying system of the present invention, it is possible to positively display and warn the user or serviceman of any normality.

Another object of the present invention is to provide a copying system which comprises cursor keys for designating a changing direction and a display for displaying various data, and the control means displays valid directions of the cursor keys on the display. According to the copying system of the present invention, it is possible to set a mode with ease because the valid directions of the cursor keys are displayed on the display.

Still another object of the present invention is to provide a copying system which comprises mode setting keys for setting modes of the copying mode and the service program mode, a display for displaying various data and indicators provided on each of the mode setting keys, and the control means turns ON the indicator of the mode setting key which coincides with the data displayed on the display. According to the copying system of the present invention, it is possible to successively set a plurality of modes with ease.

Other objects and further features of the present invention will be apparent from the following detailed description when read in conjunction with the accompanying drawings.

BRIEF DESCRIPTION OF THE DRAWINGS

FIGS. 8 and 9 are flow charts respectively showing a portion of the service program mode processing routine which follows the portion of the service program mode processing routine shown in FIG. 7;

FIG. 12 shows a second display part of the operation part for explaining the division of the second display part;

FIG. 25 shows an address map for explaining the operation of the circuit shown in FIG. 24;

FIGS. 39A through 39E, 40A, 40B and 41 are diagrams for explaining a command code;

DETAILED DESCRIPTION

Figure 1:
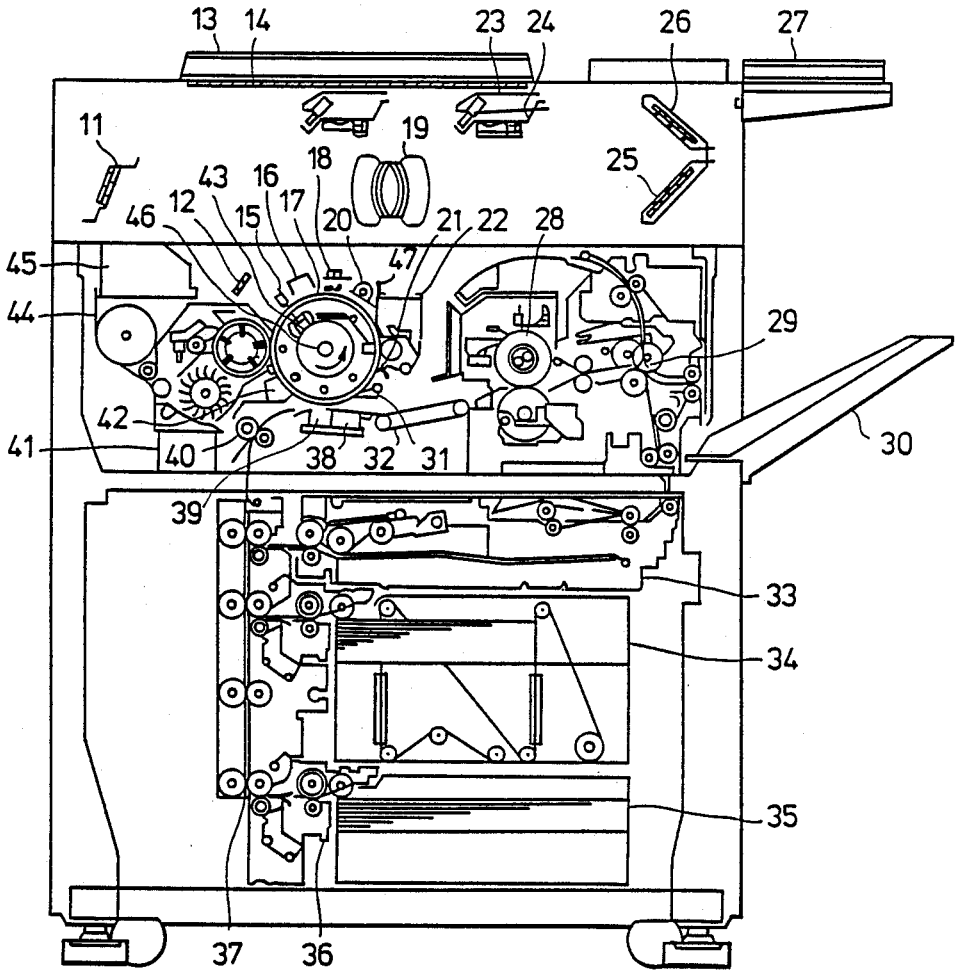
FIG. 1 is a side view generally showing an embodiment of the construction of the copying system according to the present invention.

FIG. 1 is a side view generally showing an embodiment of the copying system according to the present invention. In FIG. 1, the copying system comprises a fourth mirror 11, a glass 12 for preventing a toner from adhering onto a lens, mirror and the like, a lid 13 for holding down an original, a contact glass 14, an eraser (or erasing lamp) 15, an electrostatic charger 16, a photosensitive drum 17 using a selenium photoconductor, a drum thermistor 18 for detecting a surface temperature of the photosensitive drum 17, a lens 19, a lamp 20 for discharging the charge on the photosensitive drum 17, a pre-cleaning charger 21, a cleaning unit 22, an illumination unit 23 comprising a halogen lamp or the like, a first scanning mirror 24 which constitutes a first carriage together with the illumination unit 23 and the like, a third mirror 25, a second mirror 26, a holder 27 for placing originals before and after a copying operation, a fixing part 28 for fixing a toner image transferred on a copying paper, a reversing part 29 for reversing an ejecting direction of the copying paper after the fixing in the fixing part 28, a receiver 30 for receiving ejected copies, a separating member 31, and a transport belt 32. In addition, the copying system comprises trays 33, 34 and 35 for stocking and supplying the copy paper, a paper supplying roller unit 36, a paper transport part 37, a separating charger 38, a transfer charger 39, a resist roller 40, a developer collecting container 41 for collecting old developer when replacing it with a new developer, a pre-transfer charger 42, a drum heater 43 for raising the temperature of the photosensitive drum 17, a developer unit 44, a toner cartridge 45 for supplying the toner, a drum shaft 46 for rotatably supporting the photosensitive drum 17, and an after-cleaning charger 47. The tray 33 stocks copying papers which are used for making two-sided copies, the tray 34 stocks copying papers of a first size, and the tray 35 stocks copying papers of a second size.

Next, a description will be given on the operation of the copying system shown in FIG. 1. The photosensitive drum 17 is rotated about the drum shaft 16 in a direction of an arrow responsive to a copy instruction and the like. In order to prevent the toner and the non-uniform potential on the photosensitive drum 17 from reaching the developer unit 44, the lamp 20, the pre-transfer charger 42, the separating charger 38, the transfer charger 39, the eraser 15, the cleaning unit 22, the pre-cleaning charger 21 and the after cleaning charger 47 are driven simultaneously as the rotation of the photosensitive drum 17. The cleaning unit 22 is activated when a power source switch (or main switch, not shown) is turned ON, and thus, the surface potential of the photosensitive drum 17 after passing the lamp 20 is zero even after a paper jam or the like.

The photosensitive drum 17 is rotated by a main motor (not shown). A control part which includes a host control processing unit which will be described later in conjunction with FIG. 2 carries out a control so that a top end of an image on the photosensitive drum 17 is located at or beyond a position past the cleaning unit 22. When the photosensitive drum 17 is rotated to a predetermined rotary position, the original placed on the contact glass 14 is scanned by the first carriage which is constituted by the first scanning mirror 24, the illumination unit 23 and the like. An image formation of a reflected image on the photosensitive drum 17 is made by way of the first mirror 24, the second mirror 26, the third mirror 25, the lens 19 and the fourth mirror 24.

After the photosensitive drum 17 is charged by the electrostatic charger 16, light is irradiated on unwanted portion of the photosensitive drum 17 by the eraser 15 so as to form an image frame suited for the copying paper or the projected image. Then, a latent image is formed on the photosensitive drum 17 by the reflected image. When obtaining an image of a size identical to that of the original, the photosensitive drum 17 and the first carriage are driven at the same speed.

The latent image on the photosensitive drum 17 is visualized by the developer unit 44 as a toner image. The image density can be made low or high by applying an appropriate potential to the developer unit 44.

On the other hand, one of the copying papers stocked in the tray 33, 34 or 35 is fed by the paper supplying roller unit 36 until a paper detector (not shown) is activated. Next, the paper supplying roller unit 36 is activated again with the paper supplying timing so as to feed the copying paper to the resist roller 40 which is stationary through the paper transport part 37. The resist roller 40 is then driven with such a timing that the top end of the toner image on the photosensitive drum 17 coincides with the top end of the copying paper. The toner image on the photosensitive drum 17 is transferred onto the copying paper by the transfer charger 39. The surface of the photosensitive drum 17 is extremely smooth, and for this reason, the copying paper adheres on the photosensitive drum 17 with a large adhesive force. Accordingly, the separating charger 38 lowers the potential of the copying paper so as to reduce the adhesive force between the copying paper and the photosensitive drum 17. Then, the separating member 31 separates the copying paper from the photosensitive drum 17, and the separated copying paper is transported to the fixing part 28 by the transport belt 32. Heat and pressure are applied to the copying paper in the fixing part 28, and the toner image on the copying paper is fixed. The copying paper which has passed through the fixing part 28 is ejected as a copy via the reversing part 29.

The toner image slightly remains on the photosensitive drum 17 even after the toner image is transferred onto the copying paper. Hence, the pre-cleaning charger 21 is activated, the a cleaning brush and a cleaning blade of the cleaning unit 22 clean the surface of the photosensitive drum 17, and the surface potential of the photosensitive drum 17 is made constant by the after-cleaning charger 47 and the lamp 20.

The parts of the copying system described heretofore are controlled responsive to pulses which are generated in synchronism with the rotation of the photosensitive drum 17, or responsive to reference pulses which are used for driving the photosensitive drum 17.

Figure 2:
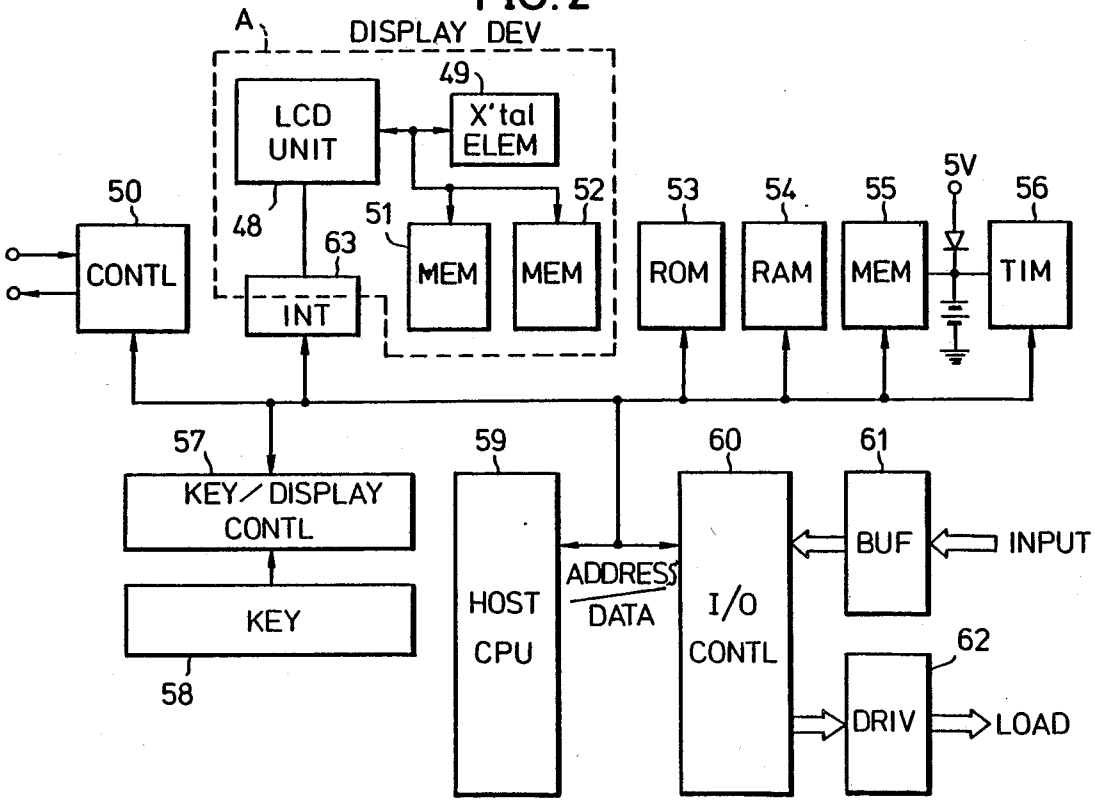
FIG. 2 is a system block diagram diagram showing an embodiment of a control system of the copying system according to the present invention.

Next, a description will be given with respect to a control system of the copying system according to the present invention, by referring to FIG. 2. In FIG. 2, the control system comprises a serial transfer controller 50, a display device A, a read only memory (ROM) 53 for control, a random access memory (RAM) 54 for control, a non-volatile memory 55 for user's use, a timing circuit 56, a key/display controller 57, keys 48, a host central processing unit (CPU) 59, an input/output (I/O) controller 60, a buffer 61 and a driver 62. The display device A comprises a liquid crystal display (LCD) unit 48, a liquid crystal element 49, a character pattern memory 51, a graphic memory 52 and an interface 53. The general operation of the control system will be described later.

Figure 3:
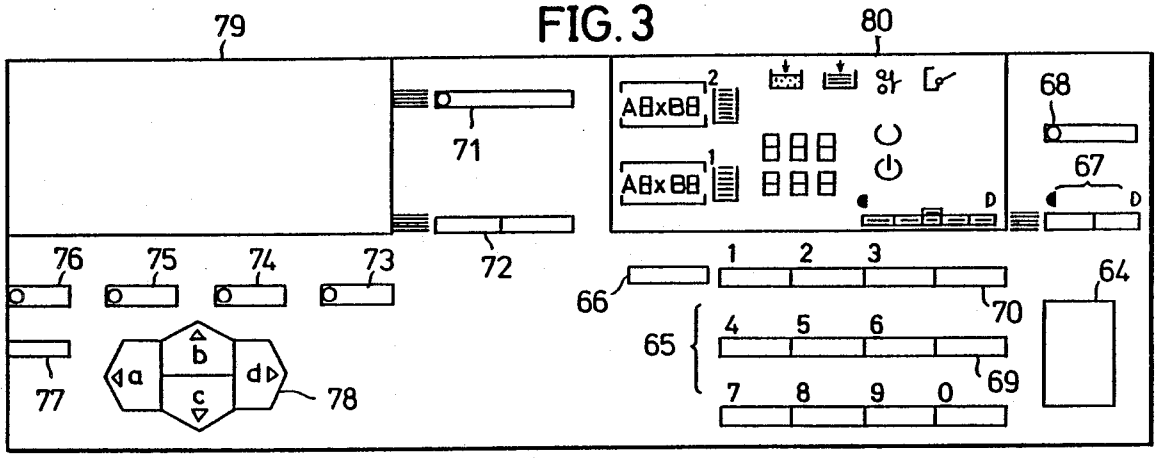
FIG. 3 is a plan view showing an embodiment of an operation part of the copying system shown in FIG. 1.

FIG. 3 shows an embodiment of an operation part of the copying system according to the present invention. On an operation panel of the operation part, there are provided a copy start key (or print key) 64, a ten-key 65 including keys "0" through "9", a select paper key 66, an image density adjusting key 67, an interrupt key 68, a clear/stop key 69, a clear mode key 70, a guidance key 71, a full size and reduce/enlarge key 72, a special reduce/enlarge key 73, a two-sided copy key 74, an image shift key 75, an edit image key 76, an enter key 77, cursor keys 78, a display part 79, and a display part 80.

The copy start key 64 is valid only when the copying system is in a state where a copying operation can be carried out and a picture word **80*f* is displayed on the display part 80. The copying operation is started by pushing the copy start key 64**.

The ten-key 65 is manipulated to set a desired number of copies to be made, and digits of the desired number of copies are shifted and set by the individual keys "0" through "9". The ten-key 65 may be used in combination with other keys to carry out various functions of the copying system. For example, the ten-key 65 may be used in combination with the edit image key 76 to erase a predetermined portion of the projected image, the ten-key 65 may be used in combination with the special reduce/enlarge key 73 to reduce or enlarge the original to a desired copy size, and the ten-key 65 may be used in combination with the enter key 77 to set a desired service program mode.

The select paper key 66 selects one of the trays 33, 34 and 35 from which the desired copying paper is to be obtained. The image density adjusting key 67 is used to adjust the image density of the copy. The interrupt key 68 interrupts the copying operation which is being carried out when pushed during the copying mode, so that a different copy can be made in a different copy mode. The operation mode is returned to the original copying mode which was interrupted when the interrupt key 68 is pushed the second time.

The clear/stop key 69 is used to discontinue the copying operation and for clearing an input made from the ten-key 65. The mode clear key 70 returns the present selected mode to an initially set mode. The guidance key 71 is used in combination with the edit image key 76, the image shift key 75, the two-sided copy key 74, the special reduce/enlarge key 73 and the like for displaying a description related to the selected mode on the display part 79.

The reduce/enlarge and full size key 72 comprises a reduce/enlarge key portion **72*a* and a full size key portion 72*b*. The reduce/enlarge key portion 72*a* selects a fixed size magnification for the copy image size in combination with the cursor keys 78. The full copy image size is selected by the full size key portion 72*b***.

The special reduce/enlarge key 73 selects a desired copy image size or an arbitrary size magnification (zoom) for the copy image size in combination with the cursor keys 78. For example, the arbitrary size magnification is selected in steps of one percent. When the desired copy image size is selected, the size magnification with which the desired copy size is obtainable from the original is selected automatically from the data entered from the ten-key 65. On the other hand, when the arbitrary size magnification is selected, the arbitrary size magnification is entered from the ten-key 65.

The image shift key 75 in combination with the cursor keys 78 shifts the end of the original image and the end of the copy paper by a predetermined quantity so as to substantially shift the image of the original in a predetermined direction on the copy by the predetermined quantity.

The edit image key 76 selects one of a combine mode, an erase image mode and an erase border mode in combination with the cursor keys 78. The images of two originals are combined in the combine mode. A portion of the original image is erased in the erase image mode, and borders of the original image are erased in the erase border mode. In the erase image mode and the erase border mode, a predetermined portion of the original image to be erased is selected by the edit image key 76 in combination with the cursor keys 78.

The two-sided copy key 74 selects a two-sided copy mode in which a two-sided copy is made from two originals or from a two-sided original. The enter key 77 sets a predetermined service program mode in combination with the clear key 70.

The cursor keys 78 are used as auxiliary keys for selecting a desired mode when a plurality of mode selection branches exist during the setting of a mode. The keys of the cursor keys 78 each have a light emitting diode (LED) which is turned ON when the key is a valid key for selecting one of the mode selection branches. The cursor keys 78 are also used for selecting the function of the DIP switches and ON/OFF state thereof.

Figure 16:
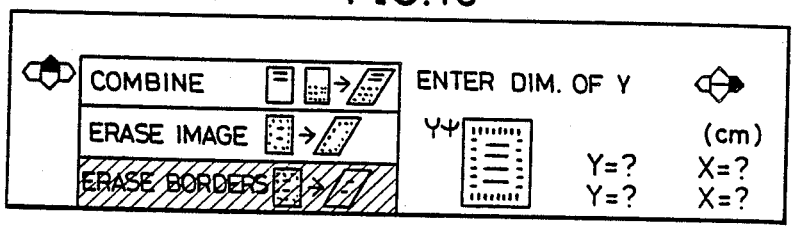
FIG. 16 shows a display on the second display part while executing the edit image mode setting routine.

The display part 79 is used to make a graphic display (full dot display) of the guidance for each mode of the copying system as will be described later in conjunction with FIG. 17, the subordinate branches during the selection of the mode as will be described later in conjunction with FIGS. 13 and 16, the content and status of the DIP switches during the service program mode as will be described later in conjunction with FIG. 18, the content of the digit switch as will be described later in conjunction with FIG. 19, the present status of the copying system such as "COPYING" as will be described later in conjunction with FIG. 4 and the like.

Figure 4:
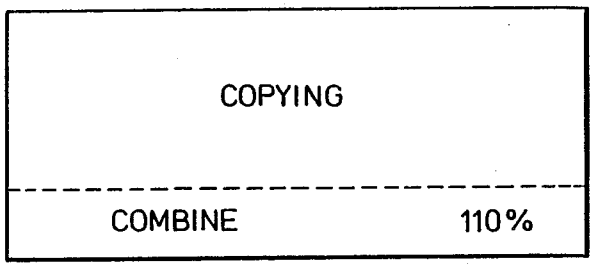
FIG. 4 shows a first display part of the operation part showing a state of the copying system.

FIG. 4 shows an embodiment of the display made on the display part 79. In FIG. 4, the display "COPYING" indicates that the copying system is presently making a copy, "COMBINE" indicates that the copying mode is set to the combine mode, and "110%" indicates that the size magnification is set to 110%. The displays "COMBINE" and "110%" made on the lower portion of the display part 79 correspond in position to the edit image key 76 and the special reduce/enlarge key 73.

The display part 80 is used to make fixed displays. In FIG. 4, picture words **80*a* and 80*b* indicate the remaining quantity of the copying papers stacked in the respective trays, picture words 80*c* and 80*d* respectively indicate the set number of copies to be made and the number of copies already made, a picture word 80*e* indicates the image density, the picture word 80*f* indicates that the copying system is ready and the copying operation can be carried out, a picture word 80*g* indicates that a fixing roller has not reached a predetermined temperature (that is, not ready) and no copying operation can yet be carried out, a picture word 80*h* indicates that a door is open, a picture word 80*i* indicates that a paper jam has occurred, a picture word 80*j* indicates that the copying system has run out of copying paper, and a picture word 80*k*** indicates that the copying system has run out of toner.

Next, a description will be given on an embodiment of the general operation of a control part of the copying system, by referring to FIG. 5. When the power source switch (not shown) is turned ON and power is supplied to the control part, a step 82 performs an initial setting routine. The initial setting routine sets the input/output mode, clears the RAM and the like, sets the number of copies to one, selects a predetermined one of the trays 33, 34 and 35, sets the size magnification to 100% and the like. Then, a step 83 performs a mechanical state detecting routine and detects various mechanical states of the copying system so as to check for remaining jammed paper, check for open door, enter the paper size and the like.

After the mechanical state detecting routine is performed in the step 83, a step 84 discriminates whether or not a paper jam flag JF is set to "1". When the discrimination result in the step 84 is YES, a step 85 outputs a jam display code $N_{jam}$ which is supplied to the operation part so as to display the picture word 80i shown in FIG. 3, and a step 86 performs a jam processing routine. On the other hand, when the discrimination result in the step 84 is NO, a step 87 discriminates whether or not an open door flag DF is set to "1". When the discrimination result in the step 87 is YES, a step 88 outputs a door open display code $N_{door}$ which is supplied to the operation part so as to display the picture word 80h, and a step 89 performs an open door processing routine. Appropriate displays are also made on the display part 79 responsive to the display codes $N_{jam}$ and $N_{door}$ according to the needs.

When the discrimination result in the step 87 is NO, a step 90 discriminates whether or not the enter key 77 and the clear key 70 have been turned ON (pushed) simultaneously to select the service program mode. When the discrimination result in the step 90 is YES, a step 91 performs a service program mode processing routine which will be described later in conjunction with FIG. 7. On the other hand, when the discrimination result in the step 90 is NO, a step 92 discriminates whether or not the special reduce/enlarge key 73 is turned ON. When the discrimination result in the step 92 is YES, a step 93 performs a special reduce/enlarge mode setting routine to make a display shown in FIG. 13 on the display part 79. In this mode, the cursor keys 78 select one of three modes which are a zoom mode, an automatic reduce/enlarge mode and a size magnification mode. In the zoom mode, an arbitrary size magnification is selected by the cursor keys 78. In the automatic reduce/enlarge mode, the size of the original is detected and the size magnification is set automatically so that the copy can be made on the selected paper size. Further, in the size magnification mode, the size magnification is set automatically from the size of the original entered from the ten-key 65 and the size of the copy entered from the ten-key 65. FIG. 13 shows a case where the zoom mode is selected as indicated by hatchings and the size magnification is set to 100%.

Figure 5:
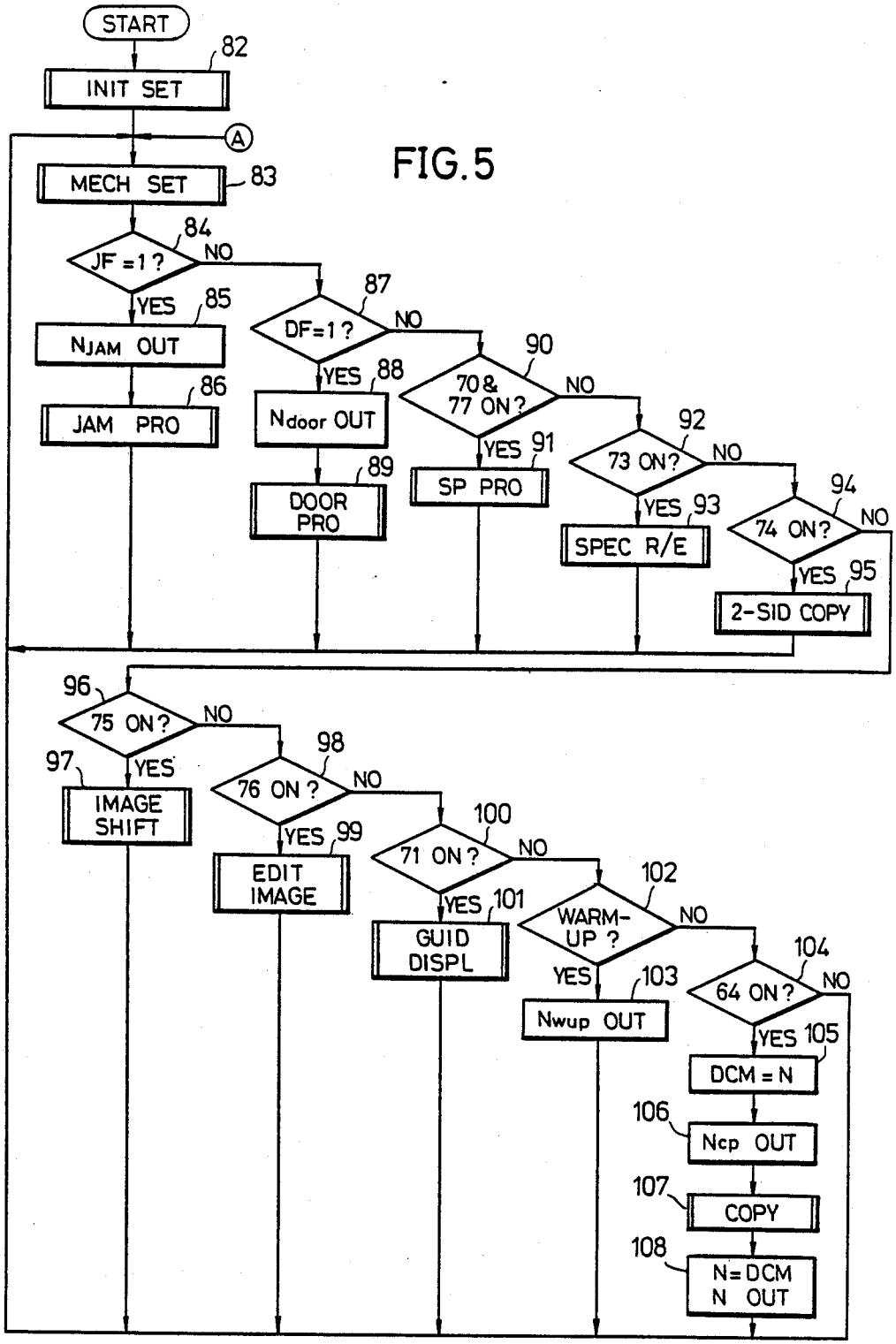
FIG. 5 is a flow chart for explaining an embodiment of the general operation of the copying system.

Returning now to the flow chart of FIG. 5, when the discrimination result in the step 92 is NO, a step 94 discriminates whether or not the two-sided copy key 74 is turned ON. When the discrimination result in the step 94 is YES, a step 95 performs a two-sided copy mode setting routine to make a display shown in FIG. 14 on the display part 79. In this mode, the cursor keys 78 select one of three modes which are one-sided original to two-sided copy mode, a two-sided original to two-sided copy mode and a two-sided original to two one-sided copies mode.

Figure 15:
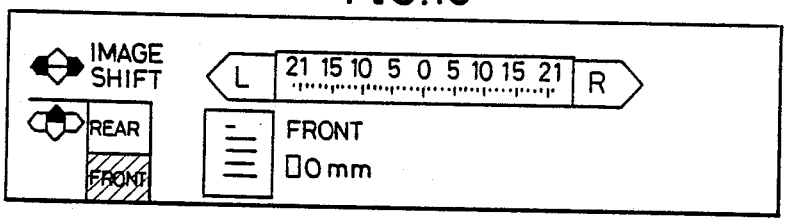
FIG. 15 shows a display on the second display part while executing an image shift mode setting routine.

When the discrimination result in the step 94 is NO, a step 96 discriminates whether or not an image shift key 75 is turned ON. When the discrimination result in the step 96 is YES, a step 97 performs an image shift mode setting routine to make a display shown in FIG. 15 on the display part 79. In this mode, the cursor keys 78 select the image shift to the right and left of a one-sided copy, and the image shift to the right and left of both sides of a two-sided copy.

When the discrimination result in the step 96 is NO, a step 98 discriminates whether or not the edit image key 76 is turned ON. When the discrimination result in the step 98 is YES, a step 99 performs an edit image mode setting routine which will be described later in conjunction with FIG. 6 to make a display shown in FIG. 16 on the display part 79. In this mode, the cursor keys 78 select one of three modes which are the erase border mode, the erase image mode and the combine mode. In the combine mode, a first copy from a first original may be obtained in the erase border mode and a second copy from a second original may be obtained in the erase image mode, so as to obtain a copy which is a combination of the first and second copies.

When the discrimination result in the step 98 is NO, a step 100 discriminates whether or not the guidance key 71 is turned ON. When the discrimination result in the step 100 is YES, a step 101 performs a guidance display routine which will be described later in conjunction with FIG. 11 to make a display shown ih FIG. 17 on the display part 79. In this mode, the cursor keys 78 select one of three modes which are a key description mode, a supply and paper remove mode and display description mode. In the key description mode, the description of the key pushed in this mode is made. In the supply and paper remove mode, the description of the supplies which need to be supplied and the paper which needs to be removed are made. Further, in the display description mode, the description of the picture word displayed on the display part 80 is made.

On the other hand, when the discrimination result in the step 100 is NO, a step 102 discriminates whether or not the copying system is still in a warm-up mode. When the discrimination result in the step 102 is YES, a step 103 outputs a warm-up display code $N_{wup}$ which is supplied to the operation part and the picture word 80g is displayed on the display part 80 to indicate that the fixing roller has not reached the predetermined temperature and no copying operation can yet be carried out.

When the discrimination result in the step 102 is NO, a step 104 discriminates whether or not the copy start key 64 is pushed. When the discrimination result in the step 104 is YES, a step 105 stores a frame code (frame number) N displayed before the copy start key 64 was pushed into a display code memory DCM. A step 106 outputs a copying display code $N_{cp}$ which is supplied to the operation part to display "COPYING" on the display part 79 as shown in FIG. 4. A step 107 performs a copying routine. When the copying routine is finished, a step 108 returns the frame code to the frame code N stored in the display code memory DCM and outputs the frame code N in order to automatically return the display to a final display made immediately before the copying operation was started so that the user can check the mode in which the copy was made.

In FIG. 5, the steps 84 and 87 for checking the paper jam flag JF and the open door flag DF are performed with a priority over the other steps 90, 92, 94, 96, 98, 100, 102 and 104. For this reason, when the flag JF or DF is set during the setting of a mode, the displays related to the setting of the mode are neglected and the picture word 80i or 80h and the like are displayed with a priority over the display related to the setting of the mode. Although omitted in FIG. 5, steps and routines may be additionally provided to display abnormalities detected in the self-check mode with a priority over other displays so that the user will be advised to call the serviceman.

Figure 6:
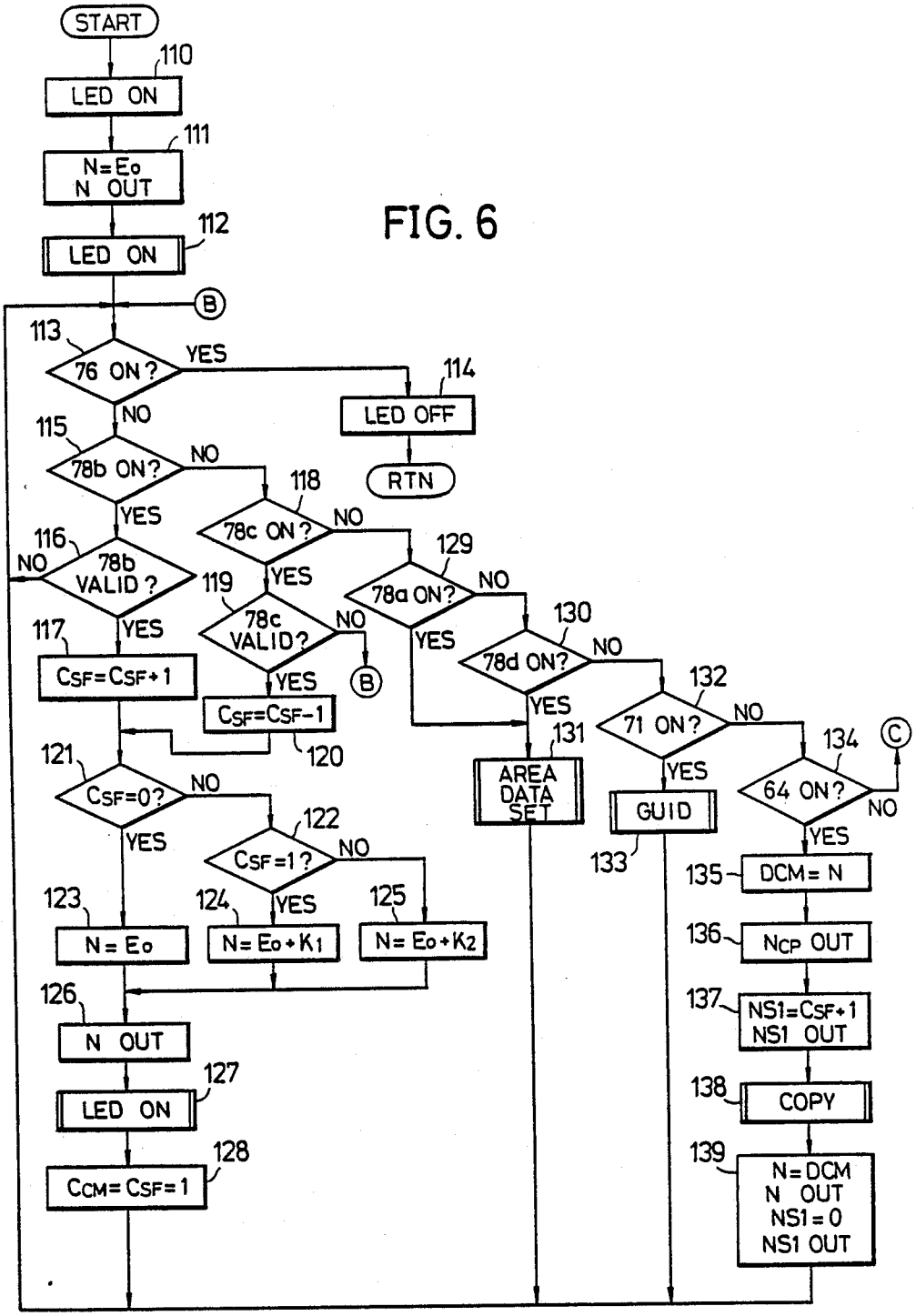
FIG. 6 is a flow chart for explaining an edit image mode setting routine in the flow chart shown in FIG. 5.
Figure 22:
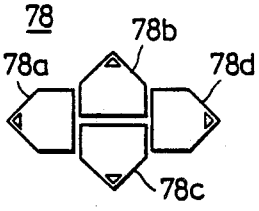
FIG. 22 shows cursor keys on an enlarged scale.

FIG. 6 is a flow chart showing a portion of the edit image mode setting routine shown in FIG. 5. When the edit image key 76 is pushed and the routine shown in FIG. 6 is started, a step 110 turns ON an LED of the edit image key 76 to indicate that the copying system is in the edit image mode. A step 111 outputs a base code $E_0$ as the frame code N, and the display shown in FIG. 16 is made on the display part 79. A step 112 performs an LED driving routine corresponding to the frame code N so as to determine which LEDs of the cursor keys 78 should be turned ON to indicate the valid cursor keys 78 for the frame code N. The cursor keys 78 are shown on an enlarged scale in FIG. 22. The cursor keys 78 comprise keys 78*a*, 78*b*, 78*c* and 78*d*, and the LEDs of each of the keys 78*a* through 78*d* are shown as triangular marks. In addition, the valid cursor keys 78 are also displayed (shown in black in FIG. 16) on the display part 79. A step 113 discriminates whether or not the edit image key 76 is turned ON for the second time in this state, and a step 114 turns OFF the LEDs of the cursor keys 78 to end the edit image mode when the discrimination result in the step 113 is YES.

When the discrimination result in the step 113 is NO, a step 115 discriminates whether or not the cursor key 78*b* is turned ON. When the discrimination result in the step 115 is YES, a step 116 discriminates whether or not the cursor key 78*b* is valid. The cursor keys 78*b* and 78*c* are turned ON and OFF when selecting one of the erase border mode, the erase image mode and the combine mode, but in the case where the erase border mode is selected as shown in FIG. 16, the cursor key 78*c* is invalid. Similarly, when the combine mode is selected, the cursor key 78*b* is invalid. The operation jumps to the step 113 when the discrimination result in the step 116 is NO. On the other hand, when the discrimination result in the step 116 is YES, a step 117 increments by one a subfunction code $C_{SF}$ indicative of each subfunction of the erase border, erase image and combine modes.

When the discrimination result in the step 115 is NO, a step 118 discriminates whether or not the cursor key 78*c* is turned ON. When the discrimination result in the step 118 is YES, a step 119 discriminates whether or not the cursor key 78*c* is valid. A step 120 decrements by one the subfunction code $C_{SF}$ when the discrimination result in the step 119 is YES. The operation jumps to the step 113 when the discrimination result in the step 119 is NO. A step 121 discriminates whether or not the subfunction code $C_{SF}$ is "0", and a step 122 discriminates whether or not the subfunction code $C_{SF}$ is "1" when the discrimination result in the step 121 is NO. A step 123 sets the frame code N to $E_0$ when the discrimination result in the step 121 is YES, a step 124 sets the frame code N to $E_0+K_1$ when the discrimination result in the step 124 is YES, and a step 125 sets the frame code N to $E_0+K_2$ when the discrimination result in the step 122 is NO, where $K_1$ and $K_2$ are constants. A step 126 outputs the frame code N, and a step 127 performs an LED driving routine corresponding to the frame code N so as to determine which LEDs of the cursor keys 78 should be turned ON to indicate the valid cursor keys 78 for the frame code N. A step 128 sets a mechanical control code (copy mode code) $C_{SM}$ to $C_{SF}+1$. The mechanical control code $C_{SM}$ is incremented by one because nothing is initially set and the mechanical control code $C_{SM}$ is initially "0".

Steps 129 and 130 respectively discriminate whether or not the cursor keys 78*a* and 78*d* are turned ON. A step 131 performs an area data setting routine to set the area data when the discrimination result in the step 129 or 130 is YES. The area data indicates which area of the original image should or should not be copied.

When the discrimination result in the step 130 is NO, a step 132 discriminates whether or not the guidance key 71 is turned ON. When the discrimination result in the step 132 is YES, a step 133 performs a guidance routine for the mode setting mode so as to display the necessary guidance for the set mode. The guidance routine for the mode setting mode will be described later in conjunction with FIG. 10.

On the other hand, when the discrimination result in the step 132 is NO, a step 134 discrimintes whether or not the copy start key 64 is turned ON. The operation advances to a routine shown in FIG. 23 when the discrimination result in the step 134 is NO. When the discrimination result in the step 134 is YES, a step 135 stacks into the display code memory DCM the frame code N displayed immediately before the copy start key 64 was turned ON, and a step 136 outputs the copying display code $N_{CP}$ which is supplied to the control part. A step 137 sets a subframe code NS1 to $C_{SF}+1$ and outputs the subframe code NS1 which is supplied to the control part. As shown in FIG. 12, the display part 79 is divided into a portion determined by the frame code N, and four portions determined by subframe codes NS1, NS2, NS3 and NS4. The subframe code NS1 indicates a subfunction of the edit image mode, the subframe code NS2 indicates the setting of the image shift mode, the subframe code NS3 indicates the subfunction of the two-sided copy mode, and the subframe code NS4 indicates the subfunction of the special reduce/enlarge mode. In the present case, "COPYING" is displayed in the portion determined by the frame code N, and "ERASE BORDERS", "ERASE IMAGE" or "COMBINE" is displayed in the portion determined by the subframe code NS1 depending on the value of the subframe code NS1.

When the copying routine is performed while the above described displays are made and the copying operation is completed, the value in the display code memory DCM replaces the value of N and this N and NS1=0 are outputted and supplied to the operation part so as to return the display to that immediately before the copying operation was started.

Figure 23:
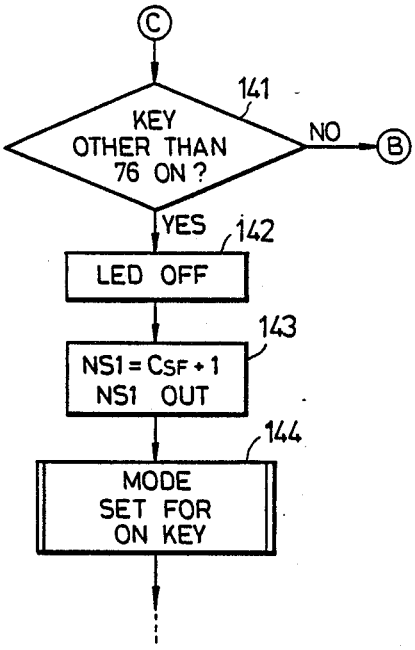
FIG. 23 is a flow chart for explaining a routine which follows the edit image mode setting routine shown in FIG. 6.

When the discrimination result in the step 134 shown in FIG. 6 is NO, a routine shown in FIG. 23 is performed. The routine shown in FIG. 23 is performed when other modes such as the special reduce/enlarge mode, two-sided copy mode (which cannot be set simultaneously with the combine mode) and the image shift mode is to be set after the subfunction (that is, the border erase mode, the image erase mode or the combine mode) of the edit image mode is set. A step 141 discriminates whether or not a mode setting key other than the edit image key 76 is turned ON. The operation jumps to the step 113 shown in FIG. 6 when the discrimination result in the step 141 is NO.

On the other hand, when the discrimination result in the step 141 is YES, a step 142 turns OFF the LED of the edit image key 76. A step 143 supplies $C_{SF}=1$ as the subframe code NS1 (subframe code 1) to the control part. A step 144 advances the operation to a mode setting routine of the key which is turned ON. In the mode setting routine, the LED of the key which is turned ON is turned ON similarly as in the case of the edit image mode setting routine, and the base frame code of the mode is supplied to the operation part. However, since $C_{SF}=1$ is supplied to the control part as the subframe code NS1, one of "ERASE BORDERS", "ERASE IMAGE" and "COMBINE" which is set is displayed on the display part 79 at the portion corresponding to NSl. As described heretofore, each LED of the mode setting key which is turned ON corresponds to the display content determined by the frame code N and enables the user to visually confirm which one of the mode setting keys is turned ON.

Figures 7, 10:
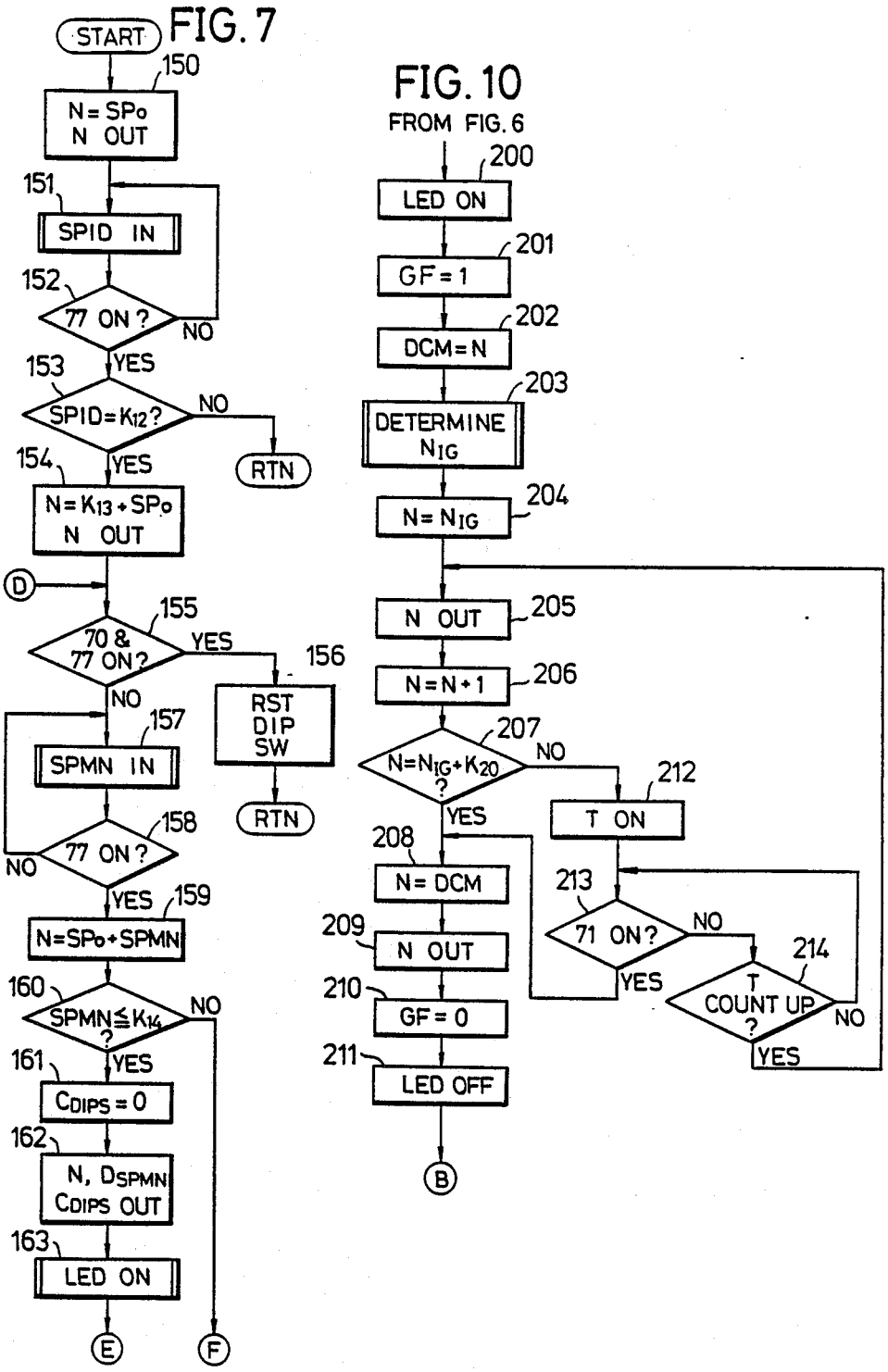
FIG. 7 is a flow chart for explaining a portion of a service program mode processing routine.
FIG. 10 is a flow chart for explaining a guidance mode during the setting of copying mode.

FIG. 7 shows a portion of the service program mode processing routine. The routine shown in FIG. 7 is performed when the enter key 77 and the clear key 70 are turned ON simultaneously. A step 150 outputs as the frame code N a base code $SP_0$ for the service program mode which is supplied to the operation part. A step 150 performs a serviceman code input routine for entering a serviceman code SPID so that the DIP switches and the digit switch will not be manipulated by someone other than the serviceman. A step 152 discriminates whether or not the enter key 77 is turned ON. The operation jumps to the step 151 when the discrimination result in the step 152 is NO. On the other hand, when the discrimination result in the step 152 is YES, a step 153 discriminates whether or not the serviceman code SPID is equal to a constant $K_{12}$. The routine is automatically returned to prevent someone other than the serviceman from making access to the service program mode when the discrimination result in the step 153 is NO.

When the discrimination result in the step 153 is YES, a step 154 adds $K_{13}$ to $SP_0$ and outputs $N=SP_0+K_{13}$ as the frame code which is supplied to the control part, where $K_{13}$ is a constant. Hence, in this mode, the display is changed to the display for inputting a memory number of the service program mode. Normally, the operation is returned from the service program mode processing routine when the enter key 77 and the clear key 70 are turned ON simultaneously. Hence, a step 155 discriminates whether or not the enter key 77 and the clear key 70 are turned ON simultaneously, and a step 156 is performed when the discrimination result in the step 155 is YES. The step 156 resets adjusting data corresponding to bits of predetermined DIP switches so as to prevent an accident in which the serviceman forgets to reset the adjusting data corresponding to bits of the predetermined DIP switches. For example, the bits of the predetermined DIP switches are free run bits, inching bits, self-check bits, specific independently driving bits and the like.

On the other hand, when the discrimination result in the step 155 is NO, a step 157 performs a memory number input routine for inputting the memory number SPMN. A step 158 discriminates whether or not the enter key 77 is turned ON, and the operation is returned to the step 157 when the discrimination result in the step 158 is NO. When the discrimination result in the step 158 is YES, a step 159 adds the memory number SPMN to $SP_0$ to obtain the frame code $N=SPMN+SP_0$. A step 160 discriminates whether or not the memory number $SPMN \leqq K_{14}$, where $K_{14}$ is a constant. The operation advances to a routine shown in FIG. 9 when the discrimination result in the step 160 is NO. When the discrimination result in the step 160 is YES, a step 161 sets a DIP switch code $C_{DIPS}$ of the memory number SPMN to "0". A step 162 outputs to the operation part the frame code N, the DIP switch code $C_{DIPS}$ and a datum $D_{SPMN}$ of the memory number SPMN. When it is assumed that SPMN=1, the display is changed to the display shown in FIG. 18. But when $C_{DIPS}=0$, a label TRIB for the DIP switch DIPSW1 is highlighted.

Figure 18:
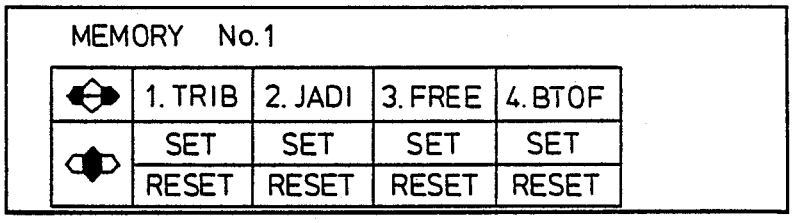
FIG. 18 shows a display on the second display part when SPMN=1 in a memory $N_0$.
Figure 19:
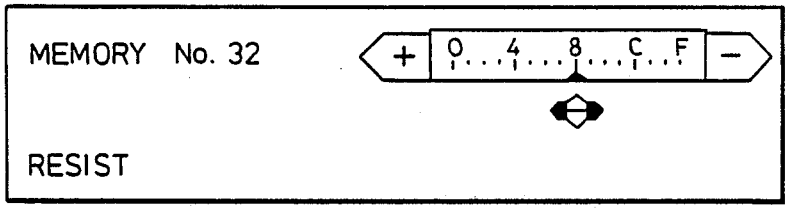
FIG. 19 shows a display on the second display part when SPMN=32 in the memory $N_0$.

In FIG. 18, the label and content of each DIP switch in the display of the memory number one (Memory No. 1) as as follows.

TABLE

| DIP Switch | Label | Service Program Mode |
|---|---|---|
| DIPSW1 | TRIB | Inching |
| DIPSW2 | JADI | Jam Display |
| DIPSW3 | FREE | Free Run |
| DIPSW4 | BTOF | Buzzer Off |

In the inching mode, the main motor and the developer motor are turned ON when the copy start key 64 is turned ON. In the jam display mode, the position where the paper jam was first detected is indicated on the display. In the free run mode, the copying operation is performed without the copying paper when the copy start key 64 is turned ON. Further, in the buzzer off mode, the buzzer is turned off from sounding the buzzer sound responsive to the manipulated key.

As may be seen from FIG. 18, in the present embodiment, no DIP switches are actually provided, but the display on the display part 79 and the keys enable the serviceman to enter adjusting data from the control part as if the DIP switches are provided. In other words, the keys and the display part 79 perform the function of the conventional DIP switches.

Figure 8:
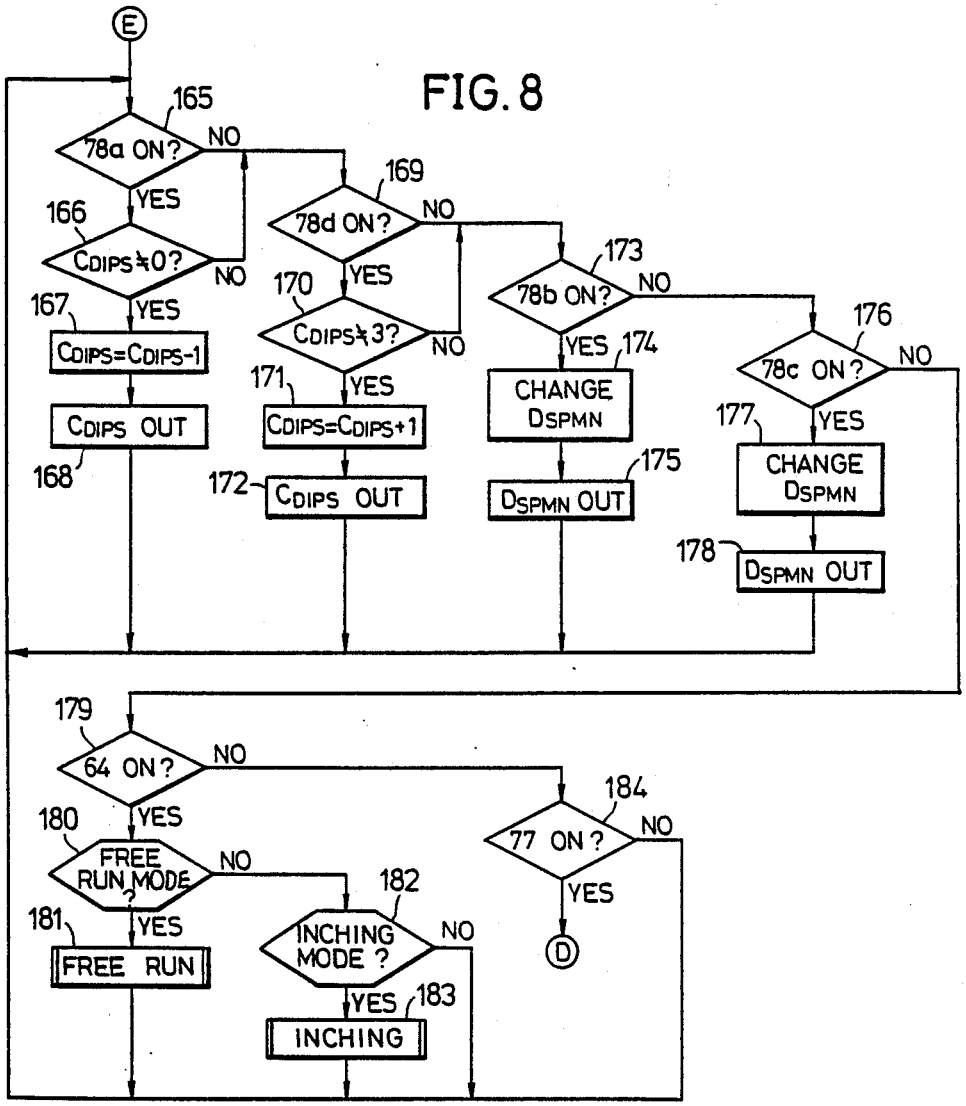

In FIG. 7, a step 163 performs an LED driving routine to turn ON the valid cursor keys 78, and the operation advances to a routine shown in FIG. 8. A step 165 discriminates whether or not the cursor key **78*a* is turned ON. When the discrimination result in the step 165 is YES, a step 166 discriminates whether or not $C_{DIPS} \neq 0$ so as to determine whether or not the cursor key 78*a* is valid. When the discrimination result in the step 166 is YES, a step 167 decrements $C_{DIPS}$ by one, and a step 168** outputs $C_{DIPS}$ which is supplied to the control part.

When the discrimination result in the step 165 or 166 is NO, a step 169 discriminates whether or not the cursor key **78*d* is turned ON. When the discrimination result in the step 169 is YES, a step 170 discriminates whether or not $C_{DIPS} \neq 3$ so as to determine whether or not the cursor key 78*d* is valid. When the discrimination result in the step 170 is YES, a step 171 increments $C_{DIPS}$ by one, and a step 172** outputs $C_{DIPS}$ which is supplied to the control part. Every time $C_{DIPS}$ is outputted, the label of the DIP switch which is highlighted changes.

When the discrimination result in the step 169 or 170 is NO, a step 173 discriminates whether or not the cursor key **78*b* is turned ON. When the discrimination result in the step 173 is YES, a step 174 changes the value of $D_{SPMN}$ so as to set the DIP switch indicated by $C_{DIPS}$, and a step 175** outputs $D_{SPMN}$ which is supplied to the control part.

On the other hand, when the discrimination result in the step 173 is NO, a step 176 discriminates whether or not the cursor key **78*c* is turned ON. When the discrimination result in the step 176 is YES, a step 177 changes the value of $D_{SPMN}$ so as to reset the DIP switch indicated by $C_{DIPS}$, and a step 178** outputs $D_{SPMN}$ which is supplied to the control part.

In FIG. 18, appropriate ones of the displays "SET" and "RESET" are highlighted every time $D_{SPMN}$ is outputted.

When the discrimination result in the step 176 is NO, a step 179 discriminates whether or not the copy start key 64 is turned ON. A step 180 discriminates whether or not the service program mode is set to the free run mode (that is, FREE of the DIP switch DIPSW3 is set). A step 181 performs the free run mode processing routine when the discrimination result in the step 180 is YES. When the discrimination result in the step 180 is NO, a step 182 discriminates whether or not the service program mode is set to the inching mode (that is, TRIB of the DIP switch DIPSW1 is set). A step 183 performs the inching mode processing routine when the discrimination result in the step 182 is YES. The service program mode is stopped when the clear/stop key 69 is turned ON during the service program mode processing routine.

When the discrimination result in the step 179 is NO, a step 184 discriminates whether or not the enter key 77 is turned ON. The operation returns to the step 155 shown in FIG. 7 when the discrimination result in the step 184 is YES. On the other hand, the operation jumps to the step 165 when the discrimination result in the step 184 is NO.

The routine shown in FIG. 9 is performed when the discrimination result in the step 160 shown in FIG. 7 is NO, that is, when the memory number thirty-two (Memory No. 32) is selected. In this case, the data related to the digit switch are displayed as shown in FIG. 19. As in the case of the DIP switches, no digit switch is actually provided in the present embodiment, but the display on the display part 79 and the keys enable the serviceman to enter data from the control part as if the digit switch is provided. In other words, the keys and the display part 79 perform the function of the conventional digit switch.

In FIG. 9, a step 186 outputs the frame code $N=SP_0+SPMN$ and $D_{SPMN}$ (datum of the digit switch indicated by SPMN) determined in the routine shown in FIG. 7. FIG. 19 shows the case where SPMN=32, that is, the case where the digit switch is for adjusting the resist. Hence, in FIG. 19, the datum of the digit switch is "8". A step 187 performs an LED driving routine so that the black portions of the display part 79 correspond to the turned ON LEDs of the valid cursor keys 78.

A step 188 discriminates whether or not the cursor key 78*a* is turned ON, and a step 189 discriminates whether or not $D_{SPMN}\neq 0$ to determine whether or not the cursor key 78*a* is valid when the discrimination result in the step 188 is YES. When the discrimination result in the step 189 is YES, a step 190 decrements $D_{SPMN}$ by one, and a step 191 outputs $D_{SPMN}$. On the other hand, when the discrimination result in the step 188 or 189 is NO, a step 192 discriminates whether or not the cursor key 78*d* is turned ON. When the discrimination result in the step 192 is YES, a step 193 discriminates whether or not $D_{SPMN}\neq F$ to determine whether or not the cursor key 78*d* is valid. When the discrimination result in the step 193 is YES, a step 194 increments $D_{SPMN}$ by one, and a step 195 outputs $D_{SPMN}$. The adjusting part of the digit switch shown in FIG. 19 shifts to the right or left every time $D_{SPMN}$ is outputted.

When the discrimination result in the step 192 or 193 is NO, a step 196 discriminates whether or not the copy start key 64 is turned ON. A step 197 performs a copying routine by use of the set $D_{SPMN}$ with the display as shown in FIG. 19 when the discrimination result in the step 196 is YES. Hence, it is possible to determine immediately whether or not the adjusting data is the optimum data. If in the negative, the value of the digit switch can be changed by turning ON the cursor key 78*a* or 78*d*, so as to check again whether or not the adjusting data is the optimum data.

On the other hand, a step 198 discriminates whether or not the enter key 77 is turned ON when the discrimination result in the step 196 is NO. The operation jumps to the step 188 when the discrimination result in the step 198 is NO, and the operation jumps to the step 155 shown in FIG. 7 when the discrimination result in the step 198 is YES.

FIG. 10 shows a flow chart for explaining the guidance mode during the setting of a mode. The routine shown in FIG. 10 is the same as the guidance routine for the mode setting mode performed in the step 133 shown in FIG. 6. The routine shown in FIG. 10 is performed when the guidance key 71 is turned ON in the edit image mode setting routine shown in FIG. 6.

In FIG. 10, a step 200 turns OFF the LED of the guidance key 71, and a step 201 sets a guidance flag GF to "1". A step 202 stores the frame code immediately before entering this mode in the display code memory DCM. A step 203 performs a $N_{IG}$ determining routine for determining from the value of N a guidance head frame code $N_{IG}$ which determines the guidance that is requested. A step 204 sets the guidance head frame code $N_{IG}$ which is determined in the step 203 as the frame code N, and a step 205 outputs the frame code N (that is, $N_{IG}$) to the operation part so as to display a guidance. A step 206 increments the frame code N by one, and a step discriminates whether or not $N=N_{IG}+K_{20}$, where $K_{20}$ is a constant, so as to determine whether or not the previously displayed guidance is from the last frame. When the discrimination result in the step 207 is YES, a step 208 returns the value in the display code memory DCM to N, and a step 209 outputs N to the control part so that the display is returned to the display immediately before entering this routine. A step 210 then resets the guidance flag GF to "0", and a step 211 turns OFF the LED of the guidance key 71. The operation is returned to the step 133 shown in FIG. 6.

On the other hand, when the discrimination result in the step 207 is NO, it means that the previously displayed guidance is not from the last frame, and a step 212 turns ON a timer T. A step 213 discriminates whether or not the guidance key 71 is turned ON, and the operation advances to the step 208 when the discrimination result in the step 213 is YES. When the discrimination result in the step 213 is NO, a step 214 discriminates whether or not the timer T is counting up. The operation returns to the step 213 when the discrimination result in the step 214 is NO, and the operation returns to the step 205 when the discrimination result i the step 214 is YES. Thus, when the guidance key 71 is turned ON, the display is returned to the display immediately before entering this routine, and the operation returns to the step 113 shown in FIG. 6. Furthermore, the incremented N is outputted when the timer T is counting up, and ON state of the guidance key 71 is again discriminated when the timer T is not counting up.

Accordingly, when the user wishes to see the guidance during the setting of the mode, the guidance can be displayed at any time when the guidance key 71 is turned ON. In addition, the display can be returned to the display related to the original setting of the mode by turning ON the guidance key 71 the second time.

Figure 11:
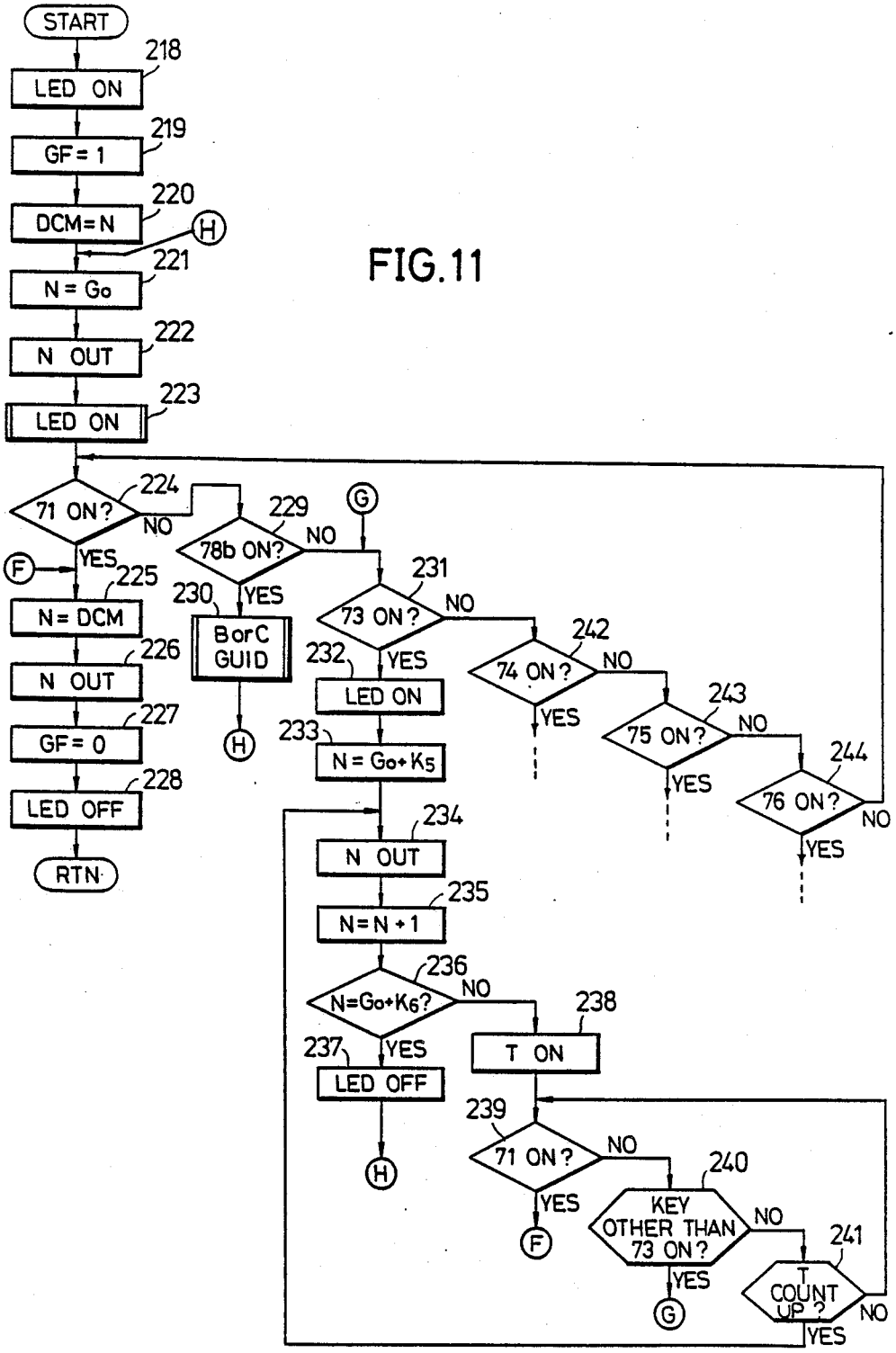
FIG. 11 is a flow chart for explaining a portion of a guidance display routine in the flow chart shown in FIG. 5.

FIG. 11 shows a portion of the guidance display routine which is performed in the step 101 shown in FIG. 5. The routine shown in FIG. 11 relates to a normal guidance mode which is performed when the guidance key 71 is turned ON. On the other hand, the routine described before in conjunction with FIG. 10 relates to the guidance mode which is performed only when the guidance key 71 is turned ON during routine shown in FIG. 6.

In FIG. 11, when the normal guidance mode is started, a step 218 turns ON the LED of the guidance key 71, and a step 219 sets the guidance flag GF to "1". A step 220 stores the frame code N immediately before entering this routine into the display code memory DCM, and a step 221 sets a base code $G_0$ for the guidance display as the frame code N. A step 222 outputs the frame code N which is supplied to the operation part. As a result, the display made in the display part 79 becomes as shown in FIG. 17.

A step 223 performs an LED driving routine so as to turn ON the LEDs of the valid cursor keys 78, and a step 224 discriminates whether or not the guidance key 71 is turned ON. When the discrimination result in the step 224 is YES, a step 225 returns the data in the display code memory DCM to N, and a step 226 outputs the frame code N. A step 227 resets the guidance flag GF to "0", a step 228 turns OFF the LED of the guidance key 71, and the routine is returned.

When the discrimination result in the step 224 is NO, a step 229 discriminates whether or not the cursor key **78*b* is turned ON. A step 230 is performed when the discrimination result in the step 229 is YES. The step 230 performs the "B SUPPLY AND PAPER REMOVE MODE" or "C DISPLAY DESCRIPTION MODE" according to the B or C guidance routine, and the operation jumps to the step 221 after the step 230**.

When the special reduce/enlarge key 73 is turned ON in the "A KEY DESCRIPTION MODE", the discrimination result in the step 231 is YES, and a step 232 turns ON the LED of the special reduce/enlarge key 73. A step 233 adds $K_6$ to $G_0$, where $K_6$ is a constant, and a step 234 outputs $G_0+K_6$ as the frame code N. A step 235 increments the frame code N by one, and a step 236 discriminates whether or not $N=G_0+K_6$, where $K_6$ is a constant. When the previously displayed guidance is the special reduce/enlarge key guidance related to the last frame, the discrimination result in the step 236 is YES, and a step 237 turns OFF the LED of the special reduce/enlarge key 73. The operation jumps to the step 221 after the step 237.

When the discrimination result in the step 236 is NO, a step 238 turns ON the timer T and a step 239 discriminates whether or not the guidance key 71 is turned ON. When the discrimination result in the step 239 is NO, a step 240 discriminates whether or not a key other than the special reduce/enlarge key 71 is turned ON, and a step 241 discriminates whether or not the timer T is counting up when the discrimination result in the step 140 is NO. The operation jumps to the step 225 when the discrimination result in the step 239 is YES, and the operation jumps to the step 231 when the discrimination result in the step 240 is YES so as to give guidance on the key other than the special reduce/enlarge key 71. When the discrimination result in the step 241 is YES, the incremented frame code N is outputted, but the operation returns to the step 239 when the discrimination result in the step 241 is NO.

When the discrimination result in the step 231 is NO, a step 242 discriminates whether or not the two-sided copy key 74 is turned ON. Steps (not shown) similar to steps 232 through 241 are performed when the discrimination result in the step 242 is YES so as to give the guidance on the two-sided copy key 74. When the discrimination result in the step 242 is NO, a step 243 discriminates whether or not the image shift key 75 is turned ON. Steps (not shown) similar to steps 232 through 241 are performed when the discrimination result in the step 243 is YES so as to give the guidance on the image shift key 75. When the discrimination result in the step 243 is NO, a step 244 discriminates whether or not the edit image key 76 is turned ON. Steps (not shown) similar to steps 232 through 241 are performed when the discrimination result in the step 244 is YES so as to give the guidance on the edit image key 76. The operation jumps to the step 224 when the discrimination result in the step 244 is NO. It is possible to provide additional steps for giving guidance to keys other than those described heretofore.

Figure 20:
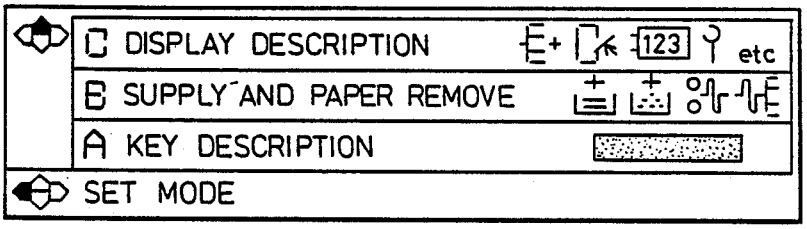
FIG. 20 shows a display on the second display part for explaining the change from a guidance display to a mode setting display of a mode setting key.
Figure 21:
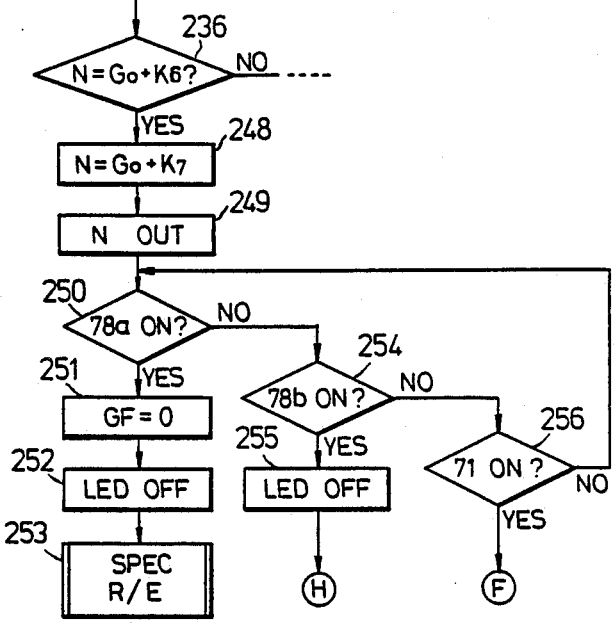
FIG. 21 is a flow chart for explaining a modification of the flow chart shown in FIG. 11.

FIG. 21 shows a modification of the steps which follow the step 236 when the discrimination result in the step 236 is YES. When the guidance of a specific key is finished and $N=G_0+K_6$, the steps shown in FIG. 21 enable the display to change to the mode to the setting of the specific key. A step 248 performs $N=G_0+K_7$, where $K_7$ is a constant, and a step 249 outputs the frame code N. In this state, the display shown in FIG. 20 is made in the display part 79.

A step 250 discriminates whether or not the cursor key **78*a* is turned ON, and a step 251 resets the guidance flag GF to "0" when the discrimination result in the step 250 is YES. A step 252 turns OFF the LED of the guidance key 71, and a step 253** performs a special reduce/enlarge mode setting routine.

When the discrimination result in the step 250 is NO, a step 254 discriminates whether or not the cursor key **78*b* is turned ON. A step 255 turns OFF the LED of the special reduce/enlarge key 73 as in the case of the flow chart shown in FIG. 11, and the operation jumps to the step 221 shown in FIG. 11**.

On the other hand, when the discrimination result in the step 254 is NO, a step 256 discriminates whether or not the guidance key 71 is turned ON. The operation jumps to the step 225 shown in FIG. 11 when the discrimination result in the step 256 is YES so as to escape from the guidance routine, and the operation returns to the step 250 when the discrimination result in the step 256 is NO.

Therefore, when setting a mode, it is possible to first confirm the key and the mode from the guidance and then continue to the routine for setting the mode.

Figure 24:
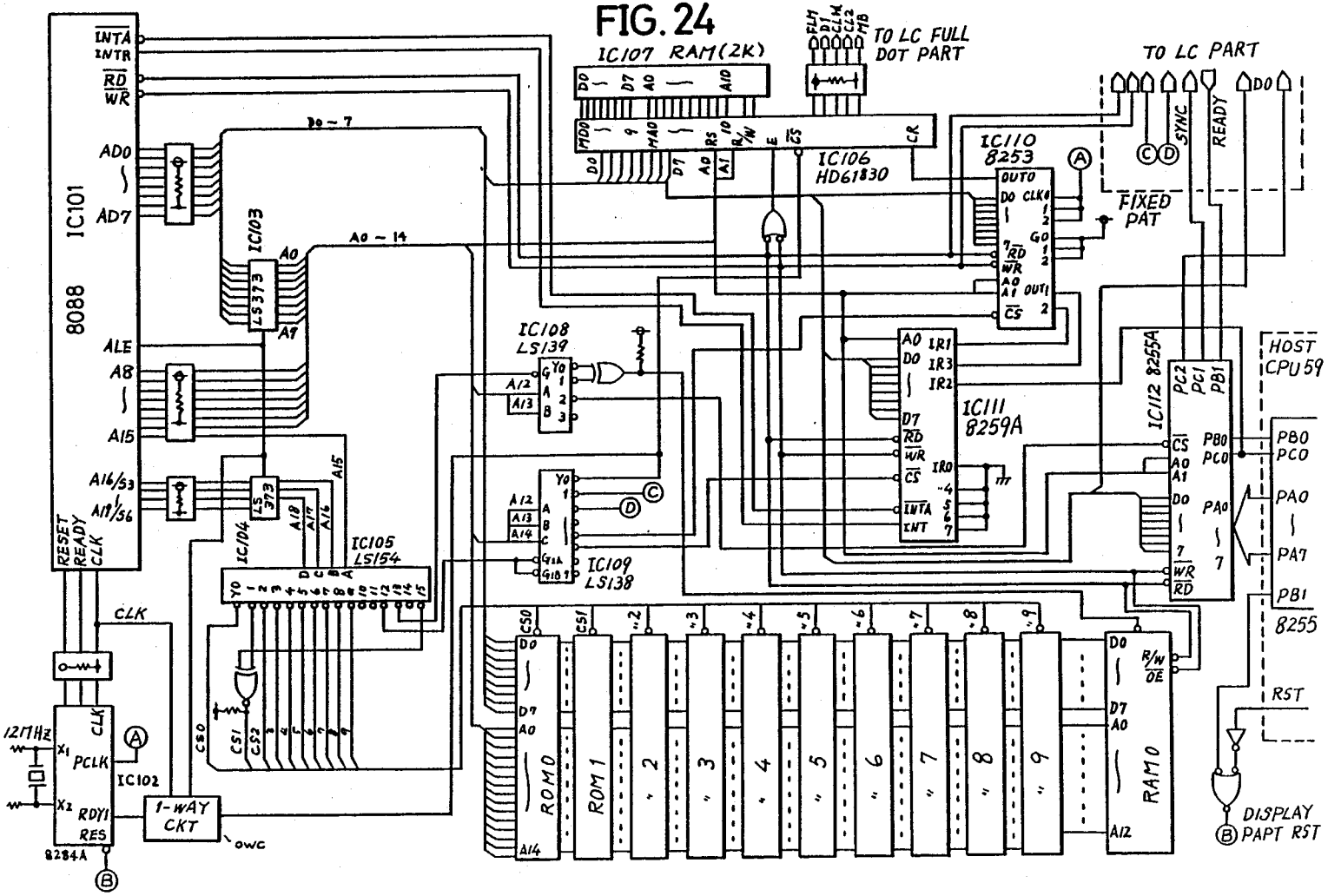
FIG. 24 is a circuit diagram showing an embodiment of a display device of the copying system according to the present invention.

Next, a description will be given with respect to the circuit construction of the display device A shown in FIG. 2 for controlling the display, by referring to FIG. 24. In FIG. 24, the illustration of the LCD element 49 is omitted. A CPU 8088 which is an 8-bit CPU that performs the internal processing in 16 bits is used for an integrated circuit IC101. The CPU 8088 has an external address space of 1 Mbyte. The CPU 8088 is used in the present embodiment because the external address space required for the LCD full dot part exceeds 64 Kbyte (64 Kbyte is the external address space of the normal 8-bit CPU), that is, the external address space required for the data related to the display content of the display part 79 and the date for control exceeds 64 Kbyte. In this case, it is possible to employ the memory banking system, but the switching of the memory bank will become complex.

The data from the terminals AD0 through AD7 of the circuit IC101 are time-divisionally separated into address and data in a circuit IC103. A chip 74LS373 may be used for the circuit IC103. After the circuit IC101 outputs the address, the circuit IC103 latches the address responsive to a falling edge of an address latch enable signal from a terminal ALE of the circuit IC101. The address and status information are outputted time-divisionally from terminals $A16/S_3$ through $A19/S_6$, and a circuit IC 104 latches the address responsive to the address latch enable signal from the terminal ALE. A chip 74LS373 may be used for the circuit IC104. Circuits IC105, IC108 and IC109 constitute a decoder. For example, chips LS154, LS139 and LS138 are respectively used for the circuits IC105, IC108 and IC109. Peripheral large scale integrated circuits (LSIs) such as ROMs ROM0 through ROM9, a RAM RAM0, a circuit IC112 and a circuit IC111 are selected by the output address of the circuit IC101.

The address map of the display device A is shown in FIG. 25. As shown in FIG. 25, the addresses 00000H through 4FFFFH are assigned to the ten 32 Kbyte ROMs ROM0 through ROM9, where H denotes hexadecimal. The addresses 60000H through 60003H are assigned for a circuit IC106 which is a controller HD61830 for LCD dot matrix graphic display. The addresses 61000H and 62000H are respectively assigned to circuits IC301 and IC302 which are controller/driver HD61602 which will be described later in conjunction with FIG. 32. The addresses 63000H through 63003H are assigned to a circuit IC110 which is a programmable interval timer 8253. The addresses 64000H through 64001H are assigned to the circuit IC111 which is a programmable interrupt controller 8259A. The addresses 68000H through 69FFFH are assigned to the static RAM RAM0. Furthermore, the addresses 6A000H through 6A003H are assigned to the circuit IC112 which is a programmable peripheral interface 8255A.

The circuit IC101 starts from the address FFF0H after being reset. In FIG. 24, a signal from a terminal Y15 of the circuit IC105 becomes low and CS1, that is, the ROM ROM1 is selected. By setting the jump instruction and the jumping address (initialize start address) from the address FFF0H of the ROM ROM1, it is possible to initialize the mechanisms after being reset.

The ROMs ROM0 and ROM1 store the processing program for the display message from the host CPU 59 at the addresses 00000H through 0FFFFH. The processing program for the display data to be displayed in the LCD element 49 (display parts 79 and 80) are stored in the ROMs ROM2 through ROM6 at the addresses 10000H through 37FFFH. The display data are stored in the ROMs ROM7 through ROM9 at the addresses 38000H through 4FFFFH.

Figure 26:
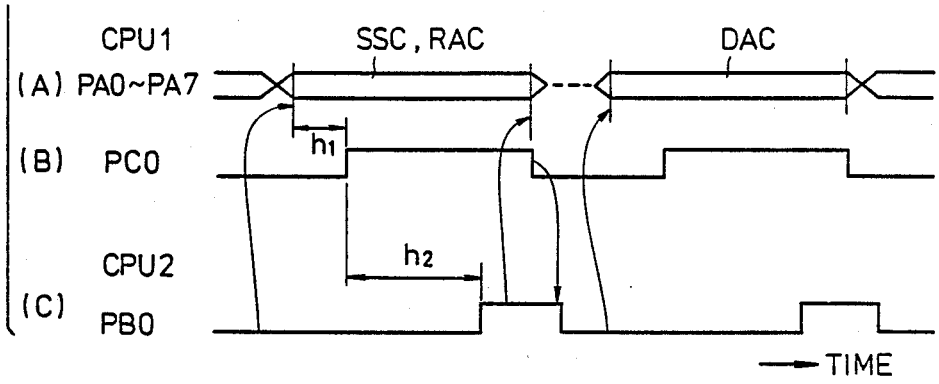
FIGS. 26(A) through 26(C) are timing charts for explaining the data transfer between a main central processing unit and a sub central processing unit.
Figure 27:
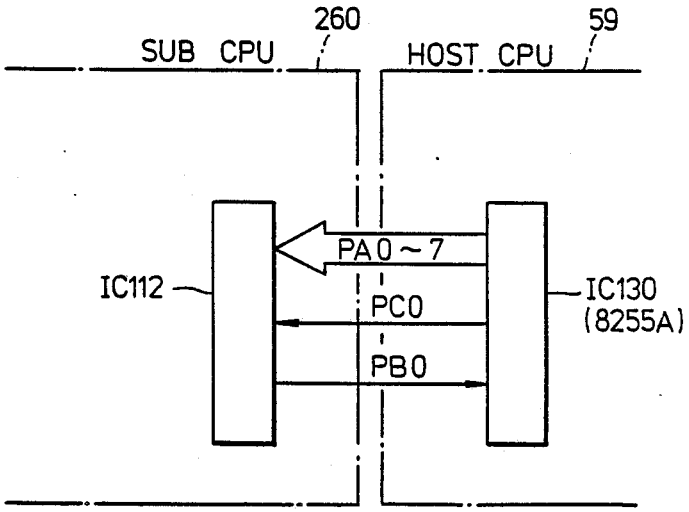
FIG. 27 is a diagram for explaining the data transfer between the main and sub central processing units.

A description will be given on the data transfer between the host CPU (main CPU) and the operation part (sub CPU), by referring to FIGS. 26 and 27. FIGS. 26(A) through 26(C) are timing charts for explaining the data transfer between the host CPU 59 and a sub CPU 260 of the operation part. The sub CPU 260 comprises the circuit IC101 shown in FIG. 24. In FIGS. 26 and 27, PA0 through PA7 denote data, PC0 denotes a strobe signal, PB0 denotes a latch signal, SSC denotes a signal selecting code, RAC denotes an area code, and DAC denotes a data code. Further, time intervals $h_1$ and $h_2$ in FIG. 26 are respectively under 5 μsec and 100 μsec.

As shown in FIG. 27, the data transfer of the data PA0 through PA7, the strobe signal PC0 and the latch signal PB0 are performed between the host CPU 59 and the sub CPU 260 via the circuits IC130 and IC112 (interfaces 8255A) of the CPUs 59 and 260 according to the handshaking system. The strobe signal PC0 is made high after the transmission data are set in the data PA0 through PA7 of the host CPU 59. The sub CPU 260 enters the data PA0 through PA7 from the circuit (interface) IC112 and stocks the data into the RAM RAM0 when the strobe signal PC0 is high. The latch signal PB0 is made high after the data PA0 through PA7 are entered. The host CPU 59 detects that the data are entered into the sub CPU 260 when the latch signal PB0 from the circuit (interface) IC130 becomes high, and makes the strobe signal PC0 low. When the strobe signal PC0 becomes low, the host CPU 59 returns the latch signal PB0 to low. By repeating such operations, the data are transmitted from the host CPU 59 to the sub CPU 260, and the sub CPU 260 receives the data from the host CPU 59.

Figure 28:
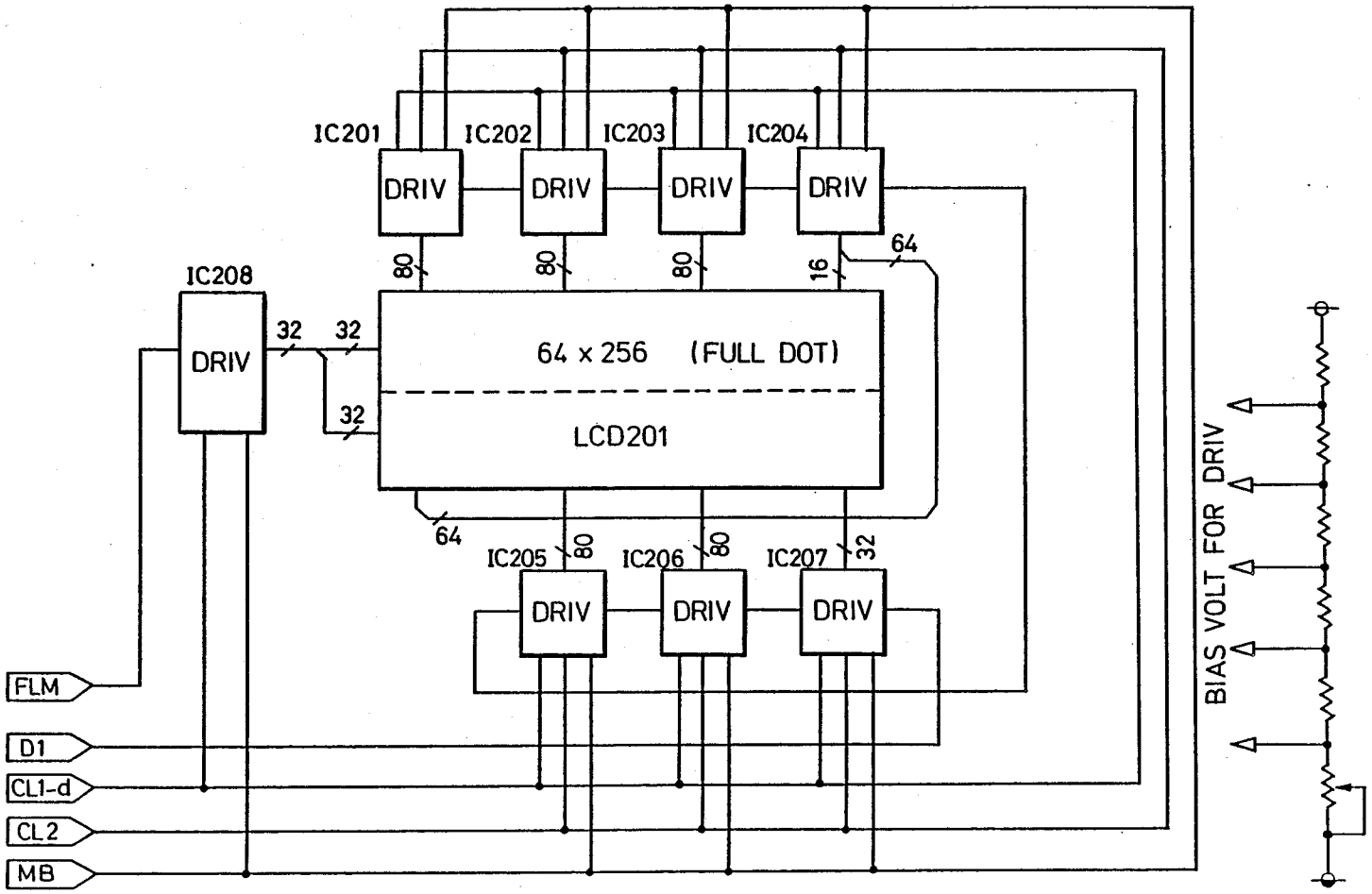
FIG. 28 is a circuit diagram showing an embodiment of a liquid crystal dot matrix module of the copying system according to the present invention.

A description will now be given on an LCD dot matrix (64×256) module which is coupled to the output of the circuit IC106 shown in FIG. 24. FIG. 28 shows an embodiment of the LCD dot matrix module. LCD driver circuits IC201 through IC207 on the segment side and an LCD driver circuit IC208 on the common side are coupled to an LCD dot matrix panel LCD201 which constitutes the display part 79 shown in FIG. 3.

The LCD dot matrix panel LCD201 has a 64×256 dot matrix, but is divided into an upper portion of 32×256 dot matrix and a lower portion of 32×256 dot matrix. By dividing the LCD dot matrix panel LCD201 into the upper and lower portions, it is possible to drive the LCD dot matrix panel LCD201 with a duty ratio of 1/32 although the LCD dot matrix panel LCD201 is a full 64×256 dot matrix, and the contract is improved compared to the case where a duty ratio of 1/64 is used.

Figure 29:
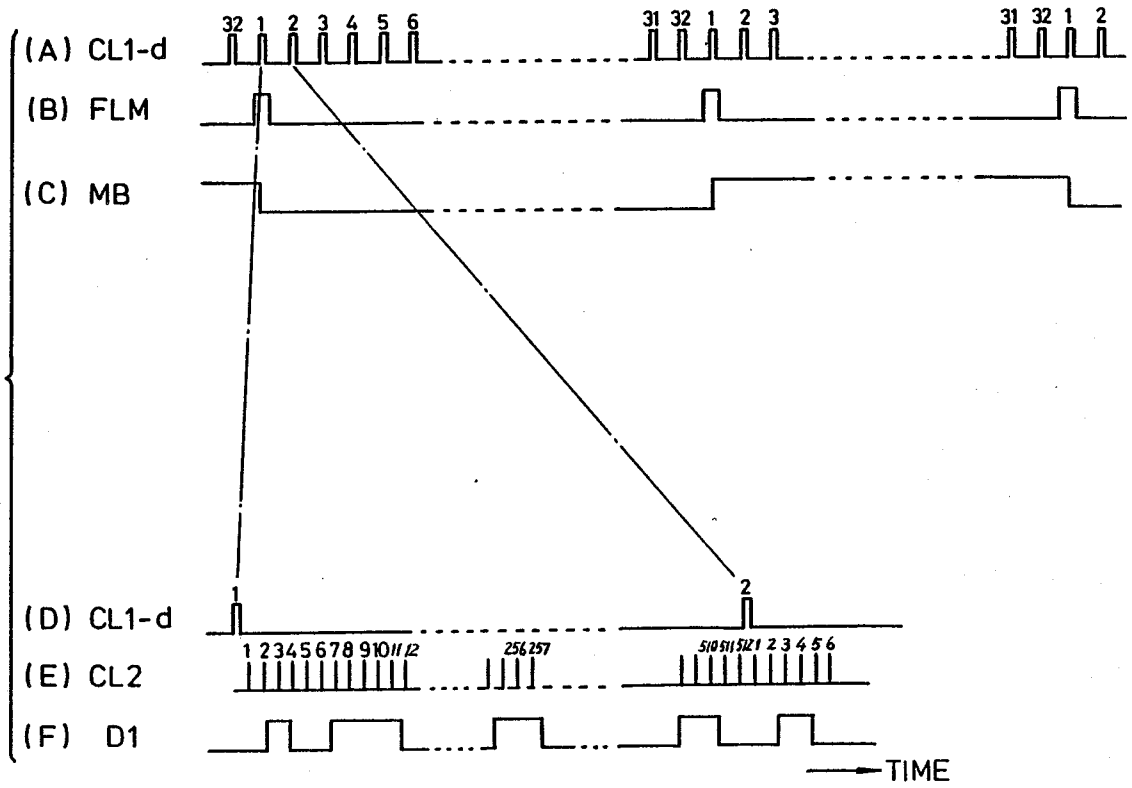
FIGS. 29(A) through 29(F) are timing charts for explaining the timing of signals supplied to the liquid crystal dot matrix module.

A frame signal FLM, a display data serial output D1, a display data latch signal CL1-d, a display data shift clock signal CL2 and an LCD driving signal MB are supplied to the LCD dot matrix panel LCD201 from the circuit IC106. FIGS. 29(A) through 29(F) respectively show the timings of the signals CL1-d, FLM, MB, CL1-d, CL2 and D1. FIG. 29(D) shows the signal CL1-d on a time base different from that of FIG. 29(A).

Figure 30A:
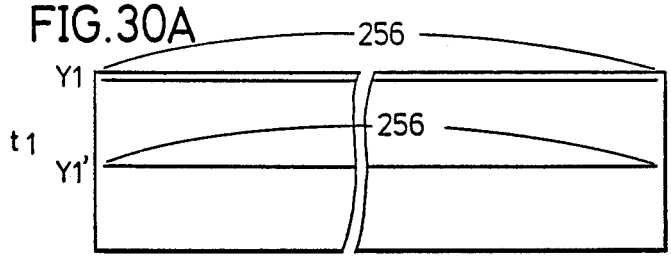
FIGS. 30(A) through 30(C) are diagrams for explaining the repetition of selected lines.
Figure 30B:
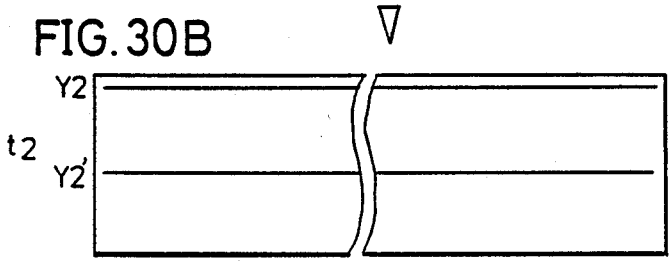
Figure 30C:
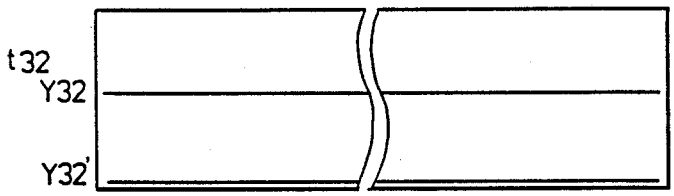

As may be seen from FIGS. 30A through 30C, a total of 512 data comprising 256 data related to the upper portion and 256 data related to the lower portion must be produced by the display data serial output D1 of the circuit IC106. The display data serial output D1 and the display data shift clock signal CL2 are produced so that 512 data are outputted between two successive pulses of the display data latch signal CL1-d, as shown in FIGS. 29(D) through 29(F). After 512 data amounting to one line are outputted, the data are latched within the LCD driver circuits IC201 through IC207 responsive to the display data latch signal CL1-d. A commercially available LCD driver may be used for the LCD driver circuits IC201 through IC208.

Figure 31:
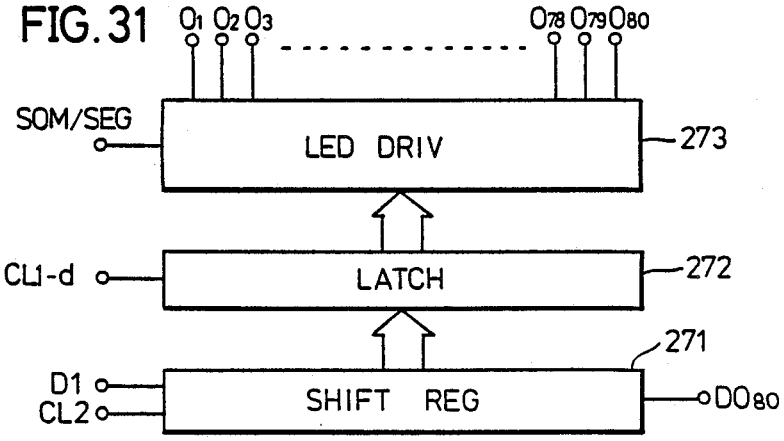
FIG. 31 is a system block diagram showing an embodiment of the internal construction of a liquid crystal display driver of the copying system according to the present invention.

FIG. 31 shows an embodiment of the internal construction of the LCD driver circuit. The LCD driver circuit comprises an 80-bit shift register 271, an 80-bit latch circuit 272 and an LCD driver 273.

The common side output of the LCD driver circuit IC208 can be controlled by the signals CL1-d and FLM respectively shown in FIGS. 29(A) and 29(B). As shown in FIGS. 30A through 30C, selected lines Y1 and Y1' are scanned at a time t1, selected lines Y2 and Y2' are scanned at a time t2, . . . , and selected lines Y32 and Y32' are scanned at a time t32. By repeating the operation of scanning from the time t1 to the time t32 a plurality of times, characters, pictures and the like become visible to the human eyes on the 64×256 dot panel.

Figure 32:
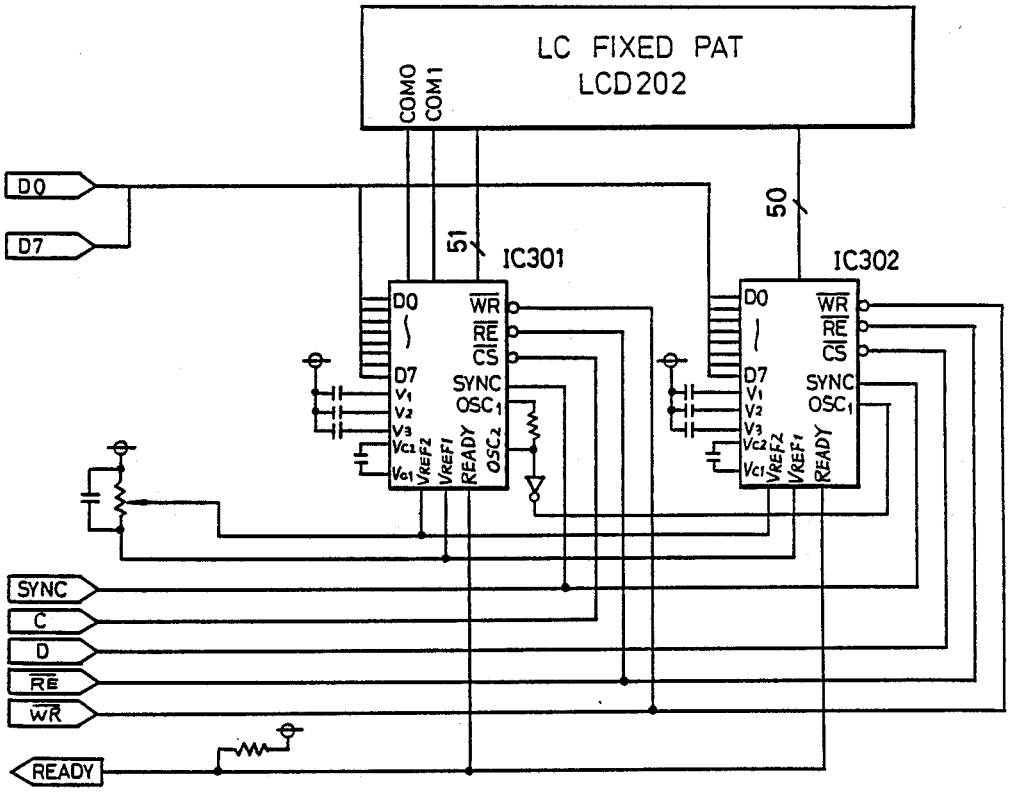
FIG. 32 is a circuit diagram showing an embodiment of a liquid crystal module of the first display part.

Next, a description will be given on an embodiment of a picture display liquid crystal module of the display part 80 shown in FIG. 3, by referring to FIG. 32. A guest host type liquid crystal is used in an LCD LCD202. In the present embodiment, the characters, pictures and the like within the picture display panel are colored into red, yellow, green and the like, and a color filter is provided for each color area. Hence, the guest host type liquid crystal is used so that only the intended characters, pictures and the like to be displayed are visible on the picture display panel. It is possible, however, to use other types of liquid crystals. The LCD LCD202 is driven at a duty ratio of ½.

One of the driver circuits IC301 and IC302 is used as a master circuit and the other is used as a slave circuit. A chip HD61602 manufactured by Hitachi, Ltd. of Japan may be used for the driver circuits IC301 and IC302. The driver circuit IC301 comprises an internal RAM for display, and it is possible to turn the segments of the characters, pictures and the like within the picture display panel (display part 80) ON and OFF by setting the display data into the internal RAM.

A description on the setting of the mode of the driver circuits IC301 and IC302 will be omitted. However, since the access such as read and write of the driver circuits IC301 and IC302 is slow, the driver circuits IC301 and IC302 produce a low level ready signal READY, and inform the sub CPU 260 via the terminal PB1 of the circuit IC112 shown in FIG. 24 that the entering of the next data should be prohibited.

Figure 33:
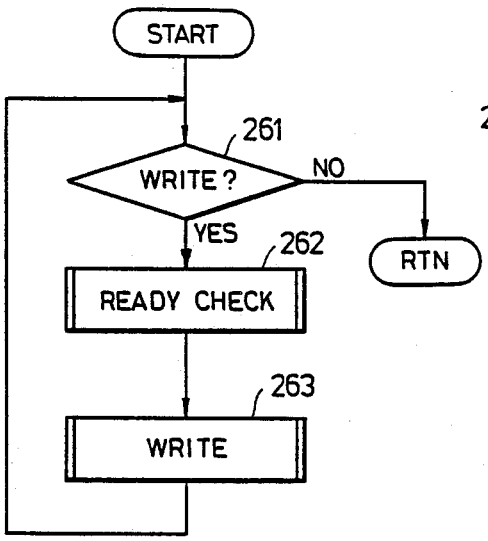
FIG. 33 is a flow chart for explaining write-in of data for the first display part.

The sub CPU 260 (circuit IC101) does not write data into the picture display liquid crystal module when at least one of the ready signals READY from the driver circuits IC301 and IC302 becomes low. As shown in FIG. 33, a step 261 discriminates whether or not data is to be written into the picture display liquid crystal module. The operation is returned when the discrimination result in the step 261 is NO. A step 262 performs a routine for checking the ready signals READY when the discrimination result in the step 261 is YES, and a step 263 writes the data into the picture display liquid crystal module.

Figure 34:
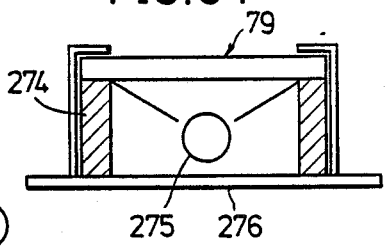
FIG. 34 is a cross sectional view showing an embodiment of a back light for the first and second display parts shown in FIG. 3.

The LCD dot matrix module and the picture display liquid crystal module both use a back light. A light bulb, a light emitting diode (LED), an electroluminescence (EL), a fluorescent panel, a fluorescent tube, a neon tube and the like may be used as the back light. In the present embodiment, a a cold-cathode discharge tube which is a type of fluorescent tube is arranged as shown in FIG. 34. A rubber connector 274 is provided on a printed circuit board 276, and a cold-cathode discharge tube (back light) 275 is arranged under the display part 79. The color of the light emitted from the cold-cathode discharge tube 275 can be selected freely by appropriately selecting the fluorescent material used in the cold-cathode discharge tube 275. The cold-cathode discharge tube 272 is advantageous in that the heat generation is small, the quantity of light can be selected freely, and a high quantity of light can be obtained. In the present embodiment, it is possible to freely turn the cold-cathode discharge tube 275 ON and OFF.

Figure 35:
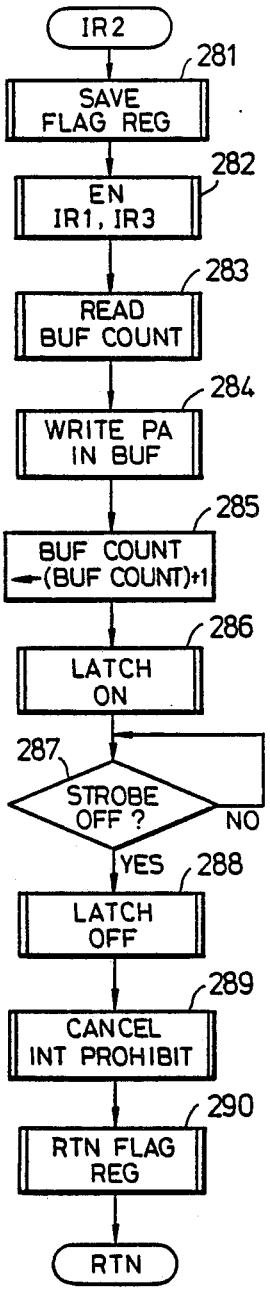
FIG. 35 is a flow chart for explaining an interrupt routine.

Next, a description will be given on interrupt routines performed during the display control. The interrupt routines are used for the data transfer between the sub CPU 260 and the host CPU 59 (interrupt IR2) and for switching timers for the display (interrupts IR1, IR3). The iterrupt IR2 is shown in FIG. 35.

The interrupt IR2 is started when a signal supplied to a terminal IR2 of the circuit IC111 (terminal PCO of circuit IC112) shown in FIG. 24 changes from low to high, that is, responsive to the edge of the signal supplied to the terminal IR2. An output signal from a terminal INT of the circuit IC111 becomes high and makes an interrupt request to the circuit IC101 (sub CPU 260). The circuit IC101 changes an interrupt acknowledge signal INTA from a terminal INTA thereof to low so as to enable interrupt vector data to be outputted on a bus. The circuit IC111 outputs an 8-bit interrupt vector when the circuit IC111 receives the interrupt acknowledge signal from the terminal INTA of the circuit IC101. The circuit IC101 jumps to an address in correspondence with the 8-bit interrupt vector and starts the interrupt routine.

When the interrupt routine for the interrupt IR2 is started, a step 281 saves contents of flag registers, and a step 282 enables the interrupts IR1 and IR3. The interrupts IR1 and IR3 are used as timers, but the step 282 is performed so that the timer values are unaffected by the interrupt IR2. The data (commands) transmitted from the host CPU 59 must be stored within the memory of the control part. Thus, a step 283 reads out content of a buffer counter, and a step 284 reads and writes in the data PA0 through PA7 into the address indicated by the buffer counter. A step 285 increments the value in the buffer counter by one, and a step 286 turns ON the latching and makes the signal at the terminal PB0 of the circuit IC112 high. A step 287 discriminates whether or not the strobe is OFF. A step 288 turns OFF the latching when the discrimination result in the step 287 becomes YES. A step 289 cancels the prohibiting of the interrupt, and a step 290 returns the saved contents of the flag registers.

Figure 36:
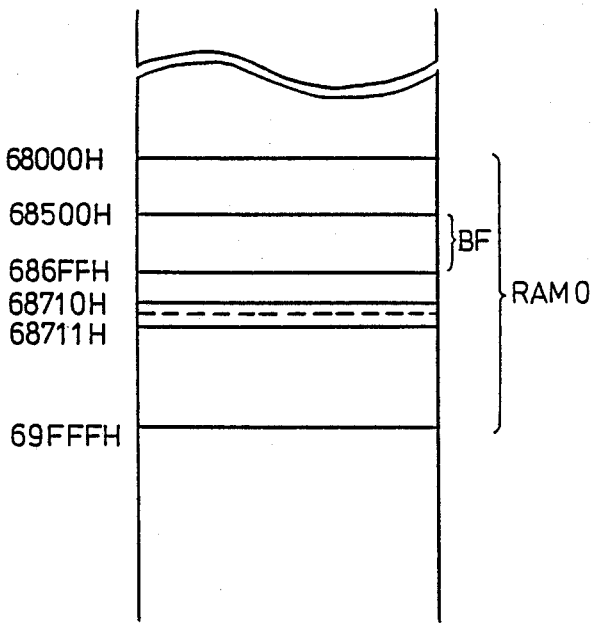
FIGS. 36 and 37 respectively show an address map of a memory which stores received data and a buffer area of the memory.

FIG. 36 shows a portion of an address map of the memory which stores the received data. A buffer area for a buffer BF (command buffer transmitted from the host CPU 59) is provided at the addresses 68500H through 686FFH within the RAM area of the RAM RAM0 provided at the addresses 68000H through 69FFFH as described before in conjunction with FIG. 25. The buffer BF is a 512-byte buffer area and can store 512 commands since each command comprises 8 bits (one byte).

Figure 37:
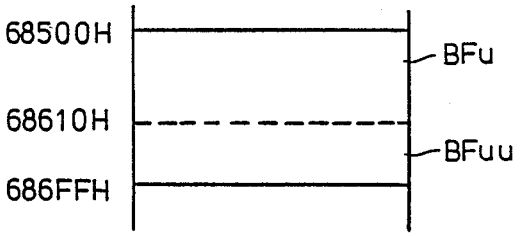

The received commands are stored from the smaller address of the buffer BF. The buffer counter comprises two bytes arranged at the addresses 68710H and 68711H, and the content of the buffer counter is the last address used in the buffer BF plus one. FIG. 37 shows a portion of the address map of the buffer BF shown in FIG. 36 on an enlarged scale. As shown in FIG. 37, the value of the buffer counter is 60000H+8610H=68610H. In FIG. 37, BFu denotes a used buffer and BFuu denotes an unused buffer.

The circuit IC110 shown in FIG. 24 is used as a programmable timer which may be programmed to perform a frequency division by n responsive to a reference clock signal of 2 MHz obtained from a terminal PCLK of a circuit IC102 which is a clock generator or to output a one-shot pulse having a desired pulse width.

In FIG. 24, a clock signal which is frequency-divided by ½ in the circuit IC110 is supplied to the circuit IC106. In addition, clock signals of 1.25 msec and 10 msec are respectively supplied to the terminals IR1 and IR3 of the circuit IC111. The interrupts IR1 and IR3 are edge triggered, and thus, the interrupt IR1 is made for every 1.25 msec and the interrupt IR3 is made for every 10 msec. A timer counter is used in the interrupts IR1 and IR3. For example, in the case of the interrupt IR3, a predetermined area or pattern on the LCD is switched ON and OFF when the value in the timer counter reaches "30". According to such an ON/OFF switching, the predetermined area or pattern on the LCD is turned ON (or OFF) for every 300 msec (10 ms×30).

As may be seen from FIG. 24, a chip 8284A is used as the circuit (clock generator) IC102 for the circuit IC101. A crystal oscillator which oscillators at 12 MHz and uses a ceramic oscillator, for example, is coupled externally to the circuit IC102. The oscillation output of the crystal oscillator is frequency-divided by ⅓ within the circuit IC102, and a clock signal of 4 MHz is obtained from a terminal CLK and is supplied to the circuit IC101. In other words, the system clock signal frequency is 4 MHz in this case.

The clock signal from the terminal PCLK of the circuit IC102 is obtained by further frequency-dividing the 4 MHz clock signal which is outputted from the terminal CLK. Hence, the clock signal from the terminal PCLK has a frequency of 2 MHz, and this clock signal is supplied to the circuit IC110.

A one-way circuit OWC is provided so as to compensate for the slow response of the circuit IC106 when a data transfer is performed between the circuits IC106 and IC101. As a result, when the circuit IC106 is selected by a chip selection, a pulse signal is supplied to the circuit IC102 from the one-way circuit OWC. The circuit IC102 supplies the ready signal READY to the circuit IC101. The circuit IC101 can delay the timings of the read and write signals from terminals RD and WR responsive to the read signal READY from the circuit IC102. Hence, it is possible to perform a satisfactory data transfer between the circuits IC101 and IC106.

Figures 38, 42:
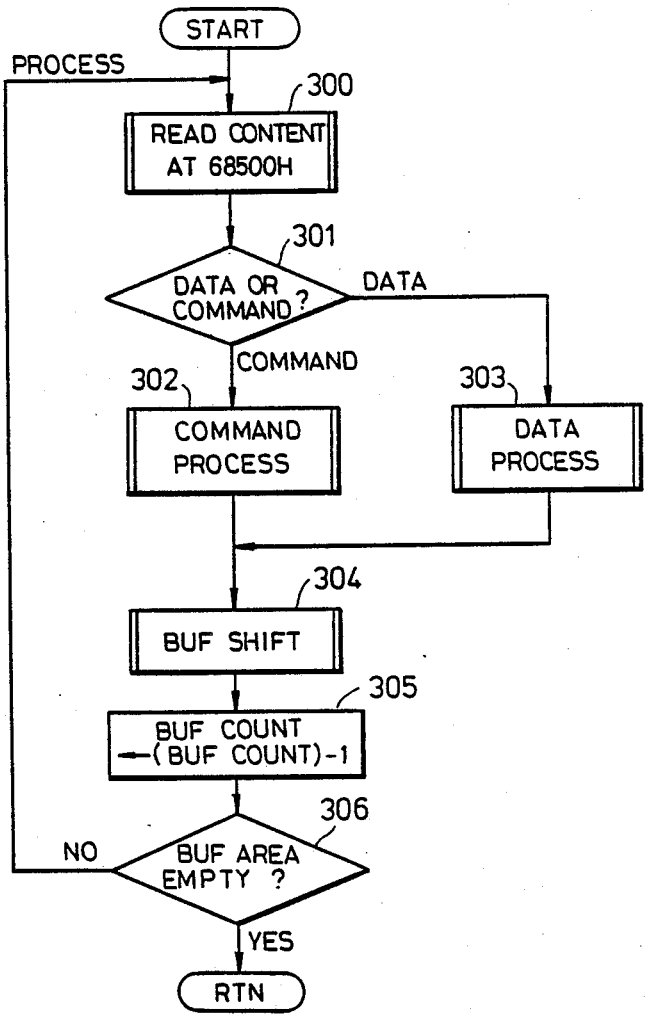
FIG. 38 is a flow chart for explaining a routine for processing a message from a main system.
FIG. 42 is a diagram for explaining a data code.

Next, a description will be given on a routine for processing the codes transmitted from the host CPU 59. FIG. 38 shows a routine for processing a message from the host CPU 59. First, a step 300 reads out the content at the first address 68500H in the buffer area of the buffer BF shown in FIG. 36. A step 301 discriminates whether or not the read out content is data or command. It is discriminated that the read out content is data when the upper 4 bits of the read out content are all "0", and it is otherwise discriminated that the read out content is a command.

When the step 301 discriminates that the read out content is a command, a step 302 performs a routine for processing the command. In the case of the command, the upper 4 bits designate the display area shown in FIG. 12 and the lower 4 bits indicates the display code of each display area. As shown in FIGS. 39A through 39E, the display areas N, NS1, NS2, NS3 and NS4 are respectively designated when the upper 4 bits of the command are "1110", "1100", "1010", "1000" and "0110". In addition, as shown in FIGS. 40A and 40B, a display area N5 which is made up of the display areas N, NS1, NS2, NS3 and NS4 and a display area which is made up of the display areas NS1, NS2, NS3 and NS4 are respectively designated when the upper 4 bits of the command are "0111" and "0100". Furthermore, as shown in FIG. 41, a picture display area NP is designated when the upper 4 bits of the command are "0011". In FIGS. 39 through 41, the bits indicated by "*" change depending on the mode.

On the other hand, when the step 301 discriminates that the read out content is data, a step 303 performs a routine for processing the data. In this case, the upper 4 bits of the data are all "0" as shown in FIG. 42, and the value of the data is determined by the lower 4 bits which are indicated by "*".

Figure 43:
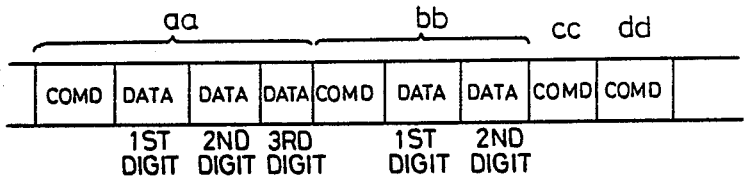
FIG. 43 is a diagram for explaining positions of the command code and the data code.

As shown in FIG. 43, the data codes are arranged after the command code, and the data codes are arranged in the sequence of the first digit data code, second digit data code, third digit data code, . . . . In the case where the display of the number is to be made in three digits, three data codes are arranged after the command code as indicated by aa. Similarly, two data codes are arranged after the command code as indicated by bb when the display of the number is to be made in two digits. The numerical value of the data differs for each mode, and the numerical values for the data portion of aa and bb in FIG. 43 differ for each mode. But no numerical data is in the commands indicated by cc and dd.

Figure 13:
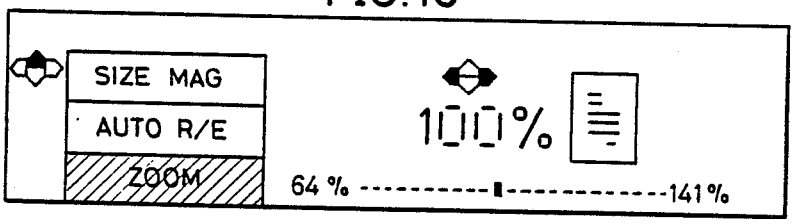
FIG. 13 shows a display on the second display part while executing a special reduce/enlarge mode setting routine.

For example, in the case of the display shown in FIG. 13, the numerical value "100" is in the display area N. An area code E2H for the display area N is first processed, and the data codes 00H, 00H and 01H are thereafter processed to display "100" as shown in FIG. 13.

Figure 14:
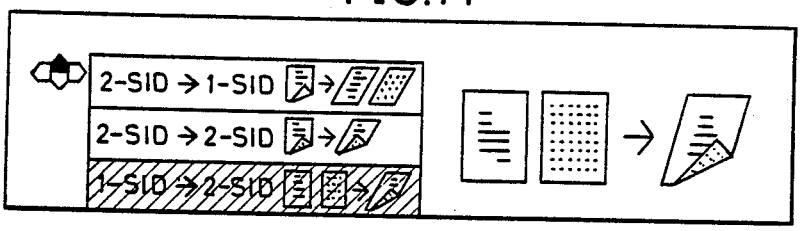
FIG. 14 shows a display on the second display part while executing a two-sided copy mode setting routine.

In the case of the display shown in FIG. 14, there is no numerical value in the display area N, and only a command exists. Hence, only a command code E3H is processed.

Figure 17:
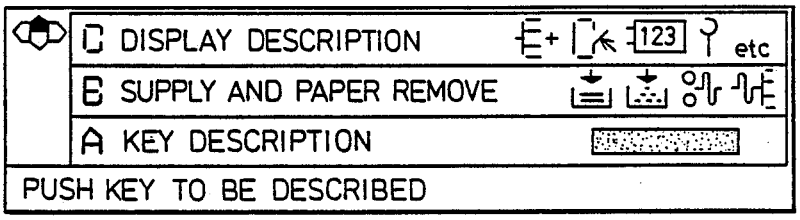
FIG. 17 shows a display on the second display part while executing a guidance display routine.

Further, in the case of the display shown in FIG. 17, all of the display areas N, NS1, NS2, NS3 and NS4 are used. In this case, there is only a command code 71H and no data code exists.

After the routine for processing the command or data is performed in the respective steps 302 and 303, a step 304 shifts the content in the buffer area of the buffer BF by one byte. A step 305 decrements the buffer counter by one. A step 306 discriminates whether or not the buffer area of the buffer BF is empty and no message remains. When the discrimination result in the step 306 is NO, the operation jumps to the step 300 so as to start processing the code. On the other hand, the operation is returned when the discrimination result in the step 306 is YES.

Next, a description will be given for the case where a command code E4H is received for the display area N shown in FIG. 39. The display area N is an area of 48×256 dots, and for this reason, display data of 48×256 bits must be set to the external RAM of the circuit IC107.

Figure 44A:
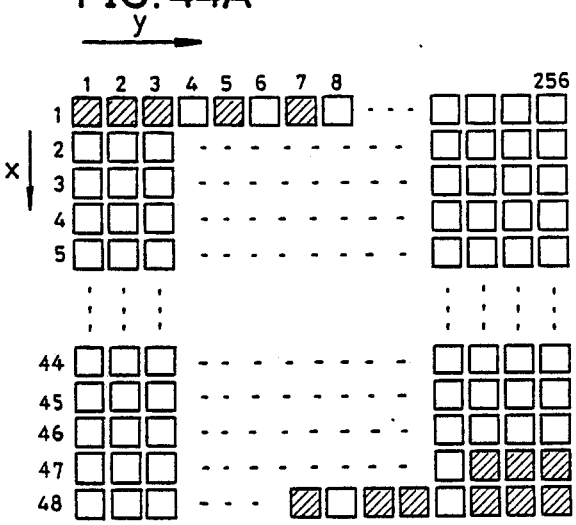
FIGS. 44A and 44B are diagrams for explaining the transfer of data within a data file.
Figure 44B:
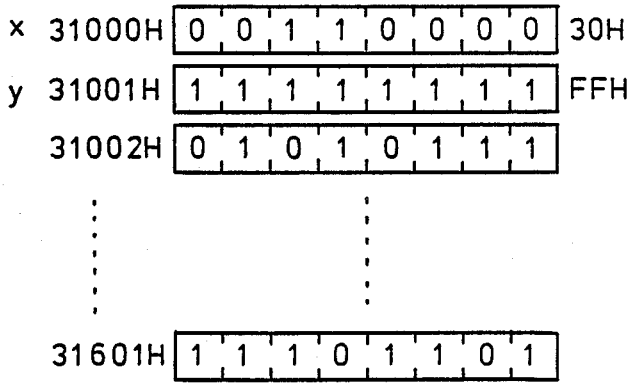
Figures 45A, 45B, 45C, 45D:
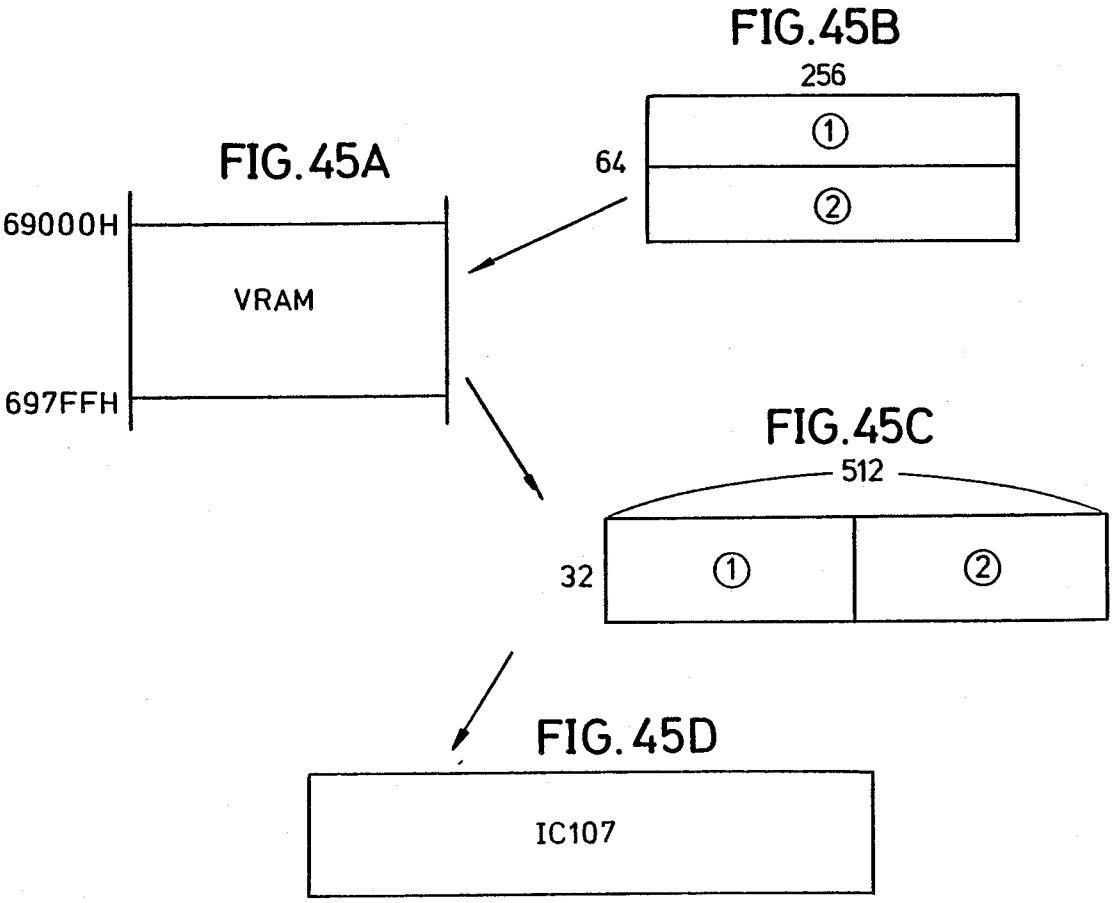
FIGS. 45A through 45D are diagrams for explaining the conversion of data when carrying out the data transfer.

When it is assumed that the code E4H is received, the data in the data file beginning from the address 31000H as shown in FIG. 44B is transferred to a video RAM VRAM of the RAM RAM0. The transfer is performed via conversions shown in FIGS. 45A through 45D. The video RAM VRAM occupies a RAM area from the address 69000H to 697FFH as shown in FIG. 45A, and has the 64×256 dot construction as shown in FIG. 45B. But the LCD employed in the present embodiment is driven with the duty ratio of 1/32, and the 64×256 dot construction must be converted into the 32×512 dot construction shown in FIG. 45C. The 32×512 dot construction thus obtained is set in the external RAM of the circuit IC106 as shown in FIG. 45D.

In FIG. 44A, the number of data in an x-direction is 48 and the number of data in a y-direction is 256. Hence, (x, y)=(48, 256)=(30H, FFH), and the first 2 bytes of the data file beginning from the address 31000H in FIG. 44B (that is, 31000H and 31001H) indicate the number of data (30H) in the x-direction and the number of data (FFH) in the y-direction. Accordingly, the data at the addresses 31002H to 31601H in FIG. 45B are display data. Since 8 bits are set in one byte, the data in the y-direction is decremented by 8 every time one byte of the display data beginning from the address 31002H is set.

As may be seen from FIG. 44A, 256 bits (=32 bytes) of the line x=1, 256 bits (=32 bytes) of the line x=2, . . ., and 256 bits (=32 bytes) of the line x=48 are successively set in the video RAM VRAM at the addresses 69000H through 697FFH.

As a result, the display corresponding to the command code E4H is displayed in the display area N shown in FIGS. 12 and 39.

The data processed similarly as the command is set in the video RAM VRAM, and the corresponding display is made by setting the data into the external RAM of the circuit IC107.

Further, the present invention is not limited to these embodiments, but various variations and modifications may be made without departing from the scope of the present invention.

What is claimed is:

1. A copying system for copying an image of an original onto a copying paper to make a copy of the original, said copying system having a copying mode for making the copy and a service program mode for adjusting parts of the copying system based on adjusting data, said copying system comprising:

a plurality of keys for selecting modes and for entering data;

input means for inputting the adjusting data for use in adjusting the parts of the copying system in the service program mode, said adjusting data being entered from said keys;

enabling and disabling means for selecting one of the copying and service program modes responsive to a manipulation of at least one of said keys;

service program mode setting means for setting an operation mode of the copying system to the service program mode responsive to a manipulation of at least one of the said keys when enabled by said enabling and disabling means, said enabling and disabling means enabling said service program mode setting means when the service program mode is selected by the keys of said enabling and disabling means and disabling said service program mode setting means when the copying mode is selected by the keys of said enabling and disabling means; and control means for automatically resetting the adjusting data entered in one or a plurality of predetermined service program modes when the service program mode setting means is disabled by said enabling and disabling means.

2. A copying system as claimed in claim 1 in which said one or a plurality of predetermined service program modes includes a free run mode in which all of the parts of the copying system operate similarly as in a copying operation but without the copying paper, and an independent driving mode in which each part of the copying system is driven independently to check the individual parts.

3. A copying system as claimed in claim 1 in which said keys include a copy start key for starting a copying operation, said control means validating an input from said copy start key in addition to inputs from other keys manipulated in the service program mode.

4. A copying system as claimed in claim 1 which further comprises a display part for displaying predetermined data, said display part and predetermined ones of said keys constituting a part of said input means and said service program mode setting means.

5. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, said control means controlling the guidance displayed on the display part so that a guidance related to one of said mode setting keys is changed to a guidance related to another one of said mode setting keys immediately after the other mode setting keys is manipulated.

6. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, said control means storing data displayed on said display part during the setting of a mode into a memory when the guidance key is manipulated a first time to display a guidance on said display part and displaying data stored in the memory on the display when the guidance key is manipulated a second time so that the data displayed on the display part is returned to the data which was displayed immediately before the guidance key was manipulated the first time.

7. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, said control means changing a display mode from a mode display mode to a guidance display mode when the guidance key is manipulated during the setting of a mode so that the display of a mode is changed to the display of a guidance related to the selected mode.

8. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, said control means switching and controlling said display part so that the operation mode of the copying system can be changed to a mode set by one of said mode setting keys when a guidance of the mode setting key displayed on said display part is finished.

9. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, said control means displaying a mode set by a manipulated one of said mode setting keys in a portion of said display part corresponding in position to the manipulated mode setting key.

10. A copying system as claimed in claim 1 which further comprises a display part for displaying predetermined data including a guidance, said keys including a copy start key for starting a copying operation, mode setting keys for setting modes of the copying and service program modes and a guidance key for selecting a guidance mode in which a guidance is displayed on said display part, said control means storing data displayed on the display part into a memory when said copy start key is manipulated and displaying the data stored in the memory when the copying operation is completed so as to return the data displayed on the display part to the data which was displayed immediately before the copy start key was manipulated.

11. A copying system as claimed in claim 1 which further comprises a display part for displaying data on a set mode, data on a mechanical state of the copying system, the adjusting data for the service program mode and data for guidance, said control means displaying on said display part specific data on the mechanical state with a priority over other data.

12. A copying system as claimed in claim 1 which further comprise a display part for displaying data, said keys including cursor keys for designating a changing direction, said control means displaying valid directions of said cursor keys on said display part.

13. A copying system as claimed in claim 12 in which said cursor keys are each provided with an indicator which controlled by said control means and is turned ON when the cursor key is valid, said control means displaying the valid directions of predetermined ones of said cursor keys having the indicator which is turned ON.

14. A copying system as claimed in claim 1 which further comprises a display part for displaying predetermined data including a guidance, said keys including mode setting keys for setting modes of the copying and service program modes and a guidance key for selecting a guidance mode in which a guidance is displayed on said display part, each of said mode setting keys being provided with an indicator, said control means turning ON the indicator of one of said mode setting keys which coincides with data displayed on said display part.

* * * * *